US008095025B2

(12) United States Patent
Ishibashi et al.

(10) Patent No.: US 8,095,025 B2
(45) Date of Patent: Jan. 10, 2012

(54) IMAGE FORMING APPARATUS CAPABLE OF EFFICIENT TONER CONCENTRATION CONTROL

(75) Inventors: Hitoshi Ishibashi, Kamakura (JP); Shin Hasegawa, Zama (JP); Kohta Fujimori, Yokohama (JP); Nobutaka Takeuchi, Yokohama (JP); Kayoko Tanaka, Tokyo (JP); Yushi Hirayama, Sagamihara (JP); Kentaroh Tomita, Sagamihara (JP); Shuji Hirai, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 464 days.

(21) Appl. No.: 11/867,391

(22) Filed: Oct. 4, 2007

(65) Prior Publication Data

US 2008/0253793 A1 Oct. 16, 2008

(30) Foreign Application Priority Data

Oct. 6, 2006 (JP) ..... 2006-274699

(51) Int. Cl.
*G03G 15/00* (2006.01)

(52) U.S. Cl. ..... 399/49; 399/74

(58) Field of Classification Search ..... 399/49, 399/51, 53, 60, 74

See application file for complete search history.

(56) References Cited

U.S. PATENT DOCUMENTS 5,198,861 A 3/1993 Hasegawa et al.
5,327,196 A 7/1994 Kato et al.
5,857,131 A 1/1999 Hasegawa
5,860,038 A 1/1999 Kato et al.
5,887,223 A * 3/1999 Sakai et al. ..... 399/60
5,933,680 A * 8/1999 Nishimura ..... 399/49
5,991,558 A * 11/1999 Emi et al. ..... 399/49
6,055,386 A 4/2000 Kato et al.
6,081,678 A * 6/2000 Kato ..... 399/49
6,160,569 A 12/2000 Fujimori et al.
6,285,839 B1 * 9/2001 Tanaka et al. ..... 399/49
6,496,677 B2 12/2002 Fujimori (Continued)

FOREIGN PATENT DOCUMENTS

JP 3533007 3/2004

(Continued)

OTHER PUBLICATIONS

U.S. Appl. No. 12/120,702, filed May 15, 2008, Hirai.

*Primary Examiner* — Sandra Brase
(74) *Attorney, Agent, or Firm* — Oblon, Spivak, McClelland, Maier & Neustadt, L.L.P.

(57) ABSTRACT

An image forming apparatus includes an image forming unit configured to form a plurality of toner images on an image carrier, an optical detector configured to detect reflection light from the toner image, and dedicated to detect infrared rays and near-infrared rays, and a controller configured to perform a predetermined control using a detection results of the optical detector. Gradation pattern that is comprised of a plurality of toner patches formed in the image forming unit with an image forming condition to have different adhesive amounts, and is formed of at least two colors, and detection values detected by the optical detector are used for the predetermined control.

20 Claims, 14 Drawing Sheets

U.S. PATENT DOCUMENTS

| | | | | |
|---|---|---|---|---|
| 6,898,381 | B2 * | 5/2005 | Maebashi et al. | 399/49 X |
| 6,975,338 | B2 | 12/2005 | Hirai et al. | |
| 7,151,901 | B2 | 12/2006 | Hirai | |
| 7,193,642 | B2 | 3/2007 | Hirai et al. | |
| 7,228,081 | B2 | 6/2007 | Hasegawa et al. | |
| 7,251,420 | B2 | 7/2007 | Fujimori et al. | |
| 2004/0251435 | A1 | 12/2004 | Sawayama et al. | |
| 2005/0019048 | A1 * | 1/2005 | Kato | 399/49 |

FOREIGN PATENT DOCUMENTS

| | | |
|---|---|---|
| JP | 2004-279664 | 10/2004 |
| JP | 2004-354623 | 12/2004 |
| JP | 2005-134778 A | 5/2005 |
| JP | 2006-139180 | 6/2006 |

* cited by examiner

IMAGE FORMING APPARATUS CAPABLE OF EFFICIENT TONER CONCENTRATION CONTROL

CROSS-REFERENCE TO RELATED APPLICATION

This patent specification is based on and claims priority from Japanese Patent Application No. 2006-274699, filed on Oct. 6, 2006 in the Japan Patent Office, the entire contents of which are incorporated by reference herein.

BACKGROUND OF THE INVENTION

1. Field of the Invention

The present invention relates to an image forming apparatus, and more particularly, to an image forming apparatus capable of efficient toner-concentration control.

2. Discussion of the Background

An image forming apparatus that employs an electrophotographic method has been developed rapidly. Such an apparatus includes a printer, a copier, a facsimile machine, and a multi-function system, for example. Recently, there is increasing demand that such image forming apparatus has high reliability to provide high quality images.

Such image forming apparatus commonly employs the following image concentration control method to maintain an excellent image quality: A gradation pattern to detect toner concentration is formed on an image carrier such as photoreceptor. The gradation pattern is comprised of a plurality of toner patches. The toner patches are formed under different image forming conditions (development potential) to have different toner adhesive amounts. The toner adhesive amount (toner concentration) of each toner patch is calculated using a predetermined adhesive-amount-calculation algorithm with a detection value.

Based on a relation between the toner adhesive amount (toner concentration) and the image forming condition (development potential), development value $\gamma$ and development-start voltage Vk are obtained. The development value $\gamma$ is a slope angle and the development-start voltage Vk is an intercept, where a horizontal axis represents the development potential and a vertical axis represents the toner adhesive amount. A LD (laser diode) power, a charging bias, a and development bias are adjusted so that the development potential provides an image forming condition to have an appropriate toner adhesive amount based on the development value $\gamma$.

The toner patch is detected by a light sensor that is an optical detection means. The light sensor generally includes an emitting device, such as an LED (Light Emitting Device), and a receiving device, such as photo transistor. For this light sensor, a regular-reflection type light sensor is generally used. In the regular-reflection type light sensor, an output value of the receiving device is high since a regular-reflection light amount is large when a receiving surface of the receiving device is flat. When the receiving surface becomes rougher, the regular-reflection light amount decreases. As a result, an output value of the receiving device is lowered. Specifically, when the toner adhesive amount is small, a large amount of the reflection light is reflected at a flat surface of the image carrier, and the output value of the receiving device increases.

On the other hand, when toner adhesive amount increases, the reflection light decreases because the surface to be detected becomes rougher due to accumulation of toner particles and the output value of the receiving device declines. Thus, there is an inverse relation between the output value from the receiving device and the toner adhesive amount. Accordingly, the toner concentration is known from the output value of the receiving device.

However, the regular-reflection type light sensor may not detect the toner adhesive amount of the toner patch accurately at a high concentration portion. This is because there is little difference between a slight rough state in which toner particles almost cover the surface of the image carrier, and a heavy rough state in which more toner particles adhere and accumulate to form layers.

The light sensor may include two receiving devices. One receiving device receives a regular-reflection light, and another receiving device receives a diffuse-reflection light. Output values of the emitting and receiving devices may change due to temperature dependence and aging of the emitting and receiving devices. Further, the output value of the receiving device is changed due to degradation of the image carrier. Therefore, it is not possible to perform toner concentration detection (toner adhesive amount detection) accurately when the toner adhesive amount is obtained solely from the detection value of the receiving device without adjustment (correction).

The following correction control is generally performed such that the toner concentration (the toner adhesive amount) of each toner patch is obtained from the output value of the receiving device that receives diffuse-reflection light (diffuse-reflection light-sensitive device). A sensitivity correction coefficient $\alpha$ is calculated from the output values of the regular-reflection receiving device and the diffuse-reflection receiving device. Using the sensitivity correction coefficient $\alpha$, the output value of the regular-reflection receiving device is broken into regular-reflection light element and diffuse-reflection light element. A ratio between an output value at a detection of the surface of the image carrier (output value of background portion) and a regular-reflection light element is determined. Then, the regular-reflection light element is transferred to normalization values $\beta[n]$ that are values from 0 to 1.

Using a value obtained by multiplying output value of the diffuse-reflection light-sensitive device by the normalization value, diffuse-reflection element from the surface of the image carrier is removed from the output value of the diffuse-reflection light-sensitive device so as to extract the diffuse-reflection element from the toner.

Using the normalization values $\beta[n]$ and the diffuse-reflection element, the sensitivity correction coefficient n that corrects the output value of the diffuse-reflection light-sensitive device is calculated. The output value of the diffuse-reflection light-sensitive device is corrected by multiplying the diffuse-reflection element from the toner, i.e., an extraction of the output value of the diffuse-reflection light-sensitive device, by the sensitivity correction coefficient $\eta$. The toner adhesive amount is then uniquely determined by the output value of the diffuse-reflection light-sensitive device corrected with the sensitivity correction coefficient $\eta$.

The output value of the receiving devices are corrected by the sensitivity correction coefficients $\alpha$ and $\eta$ even when the output values of the receiving devices are changed due to temperature change and aging of the receiving devices. The relation between the output value of the receiving device and the toner adhesive amount is corrected to have a unique relation. Consequently, the light sensor can maintain high-performance detection of the toner adhesive amount accurately by overcoming aging of the receiving devices.

The above-described correction control for the light sensor is achieved by forming a gradation pattern having a plurality of toner patches, i.e., 10 through 16 toner patches, with different adhesive amounts for each color. FIG. 19 is an example of the gradation pattern TK(k), TK(m), TK(c) and TK(y), for each color formed on the intermediate transfer belt that is an image carrier. For this reason, a total length of the gradation pattern including each color pattern increases as shown in FIG. 19. Accordingly, a period from a time the light sensors 310K, 310M, 310C and 310Y start detection to a time the light sensors 310K, 310M, 310C and 310Y end the detection increases. As a result, a correction time to correct the light sensors 310K, 310M, 310C and 310Y increases and a down time of a system increases.

Focusing on the correction time, as shown in FIG. 20, the light sensors 310K, 310M, 310C and 310Y are provided to detect gradation patterns TK(k), TK(m), TK(c), TK(y) of colors K, M, C and Y, respectively. The total length L of the gradation pattern decreases in comparison to the pattern shown in FIG. 19 such that the down time of the system is reduced. However, the cost of the system increases because more light sensors are necessary for each color.

It has been observed that the total length of the toner patches can be shortened, the down time of the system reduced, and toner consumption decreased if a number of toner patches for each color is reduced. Consequently, the inventors have focused their investigations on a light sensor dedicated to detect infrared rays and near-infrared rays, and discovered how to reduce the number of toner patches necessary for correction control.

In conventional systems, toner adhesive amount target values are determined to be equal for each toner patch of the gradation pattern with respect to the colors Y, C, and M. Specifically, three toner patches having equal toner adhesive amounts of different colors are formed as shown in FIG. 21. If the light sensor that detects infrared rays and near-infrared rays is used, three identical detection values are obtained because the reflection rates of the infrared rays and near-infrared rays do not depend on the toner color.

Light sensor correction control to correct the sensitivity of the light sensor using detection results for the gradation pattern is a control to calculate the above-described sensitivity correction coefficients $\alpha$ and $\eta$.

The sensitivity correction coefficient $\alpha$ is the minimum value of $\alpha$ ratio between an output value of the regular-reflection receiving device ($\Delta$Vsp_reg) and an output value of the diffuse-reflection receiving device ($\Delta$Vsp_dif). Specifically, a process to calculate the sensitivity correction coefficient $\alpha$ involves finding the minimum value from the ratios of output value of regular-reflection receiving device ($\Delta$Vsp_reg) and output value of diffuse-reflection receiving device ($\Delta$Vsp_dif).

Using the light sensor that detects the infrared rays and near-infrared rays, the above-described ratio is changed by differences in toner concentration of the toner patches. However, equal values may be obtained independently for the colors if the toner concentration is equal. Therefore, when a conventional gradation pattern having equal gradation for each color is detected and the above-described ratios are determined using the light sensor that detects the infrared rays and near-infrared rays, three output values are identical.

The sensitivity correction coefficient $\alpha$ is determined by the minimum value of ($\Delta$Vsp_reg [n]/$\Delta$Vsp_dif [n]). Consequently, calculation accuracy does not improve even with a plurality of data points at equal positions. Therefore, one of the colors Y, M, and C may be enough to calculate the sensitivity correction coefficient $\alpha$ with respect to toner patches P8, P9 and P10 at the high concentrate portion of the gradation pattern.

To obtain the sensitivity correction coefficient $\eta$, the data points detected from the toner patch are generally plotted in a graph. In the graph, the horizontal axis represents a normalization value from regular reflection element of output value of the regular-reflection-light receiving device and the vertical axis represents the diffuse-reflection element of output value of the diffuse-reflection-light receiving device.

The sensitivity correction coefficient $\eta$ is obtained from the plotted line of the toner patches P2, P3 and P4 at low concentration portion. Using the light sensor that detects the infrared rays and near-infrared rays, it is found that the data points are plotted at almost equal positions when the conventional gradation pattern having equal concentration for each color is detected.

Generally, if the data points are uniformly distributed, a plotted line can be recognized correctly, and calculation accuracy of the sensitivity correction coefficient $\eta$ improves. However, the calculation accuracy does not improve if a plurality of data points are at an equal position. Consequently, with respect to toner patch P2, P3 and P4 at low concentrate portion of the gradation pattern, one of the colors Y, M, and C may be enough to calculate the sensitivity correction coefficient $\eta$.

Based on the foregoing discussion, it is possible to calculate the sensitivity correction coefficients $\alpha$ and $\eta$ if the gradation pattern is formed by one of the colors Y, M, and C for the toner patches at low concentrate portion P2, P3 and P4, and for toner patches at high concentrate portion P8, P9 and P10 using the light sensor that detects the infrared rays and near-infrared rays.

Thus, the number of toner patches can be reduced and the toner consumption can be reduced. Moreover, detection time to detect the toner patches is shortened and it is possible to perform the correction control on the light sensor in a short time, thus reducing down time of the system.

However, one of color toners, i.e., Y, M, and C color toners, may be consumed more quickly than the other color toners, in which case the times to replace the color toner bottles may vary between colors, necessitating replacing the toner bottles frequently.

SUMMARY OF THE INVENTION

This patent specification describes a novel image forming apparatus including an image forming unit configured to form a plurality of toner images on an image carrier, an optical detector configured to detect reflection light from the toner image and dedicated to detect infrared rays and near-infrared rays, and a controller configured to perform a predetermined control using a detection results of the optical detector. A gradation pattern that is comprised of a plurality of toner patches formed in the image forming unit with an image forming condition to have different adhesive amounts, and is formed of at least two colors, and detection values detected by the optical detector are used for the predetermined control.

Further, this patent specification describes a novel image forming apparatus including the optical detector that includes an emitting device to emit infrared rays and near-infrared rays and a receiving device to receive infrared rays and near-infrared rays.

This patent specification further describes a novel image forming apparatus in which an image forming condition is determined by multiplying reference potential that is a development potential to form a reference image having a predetermined toner adhesive amount by predetermined different values.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
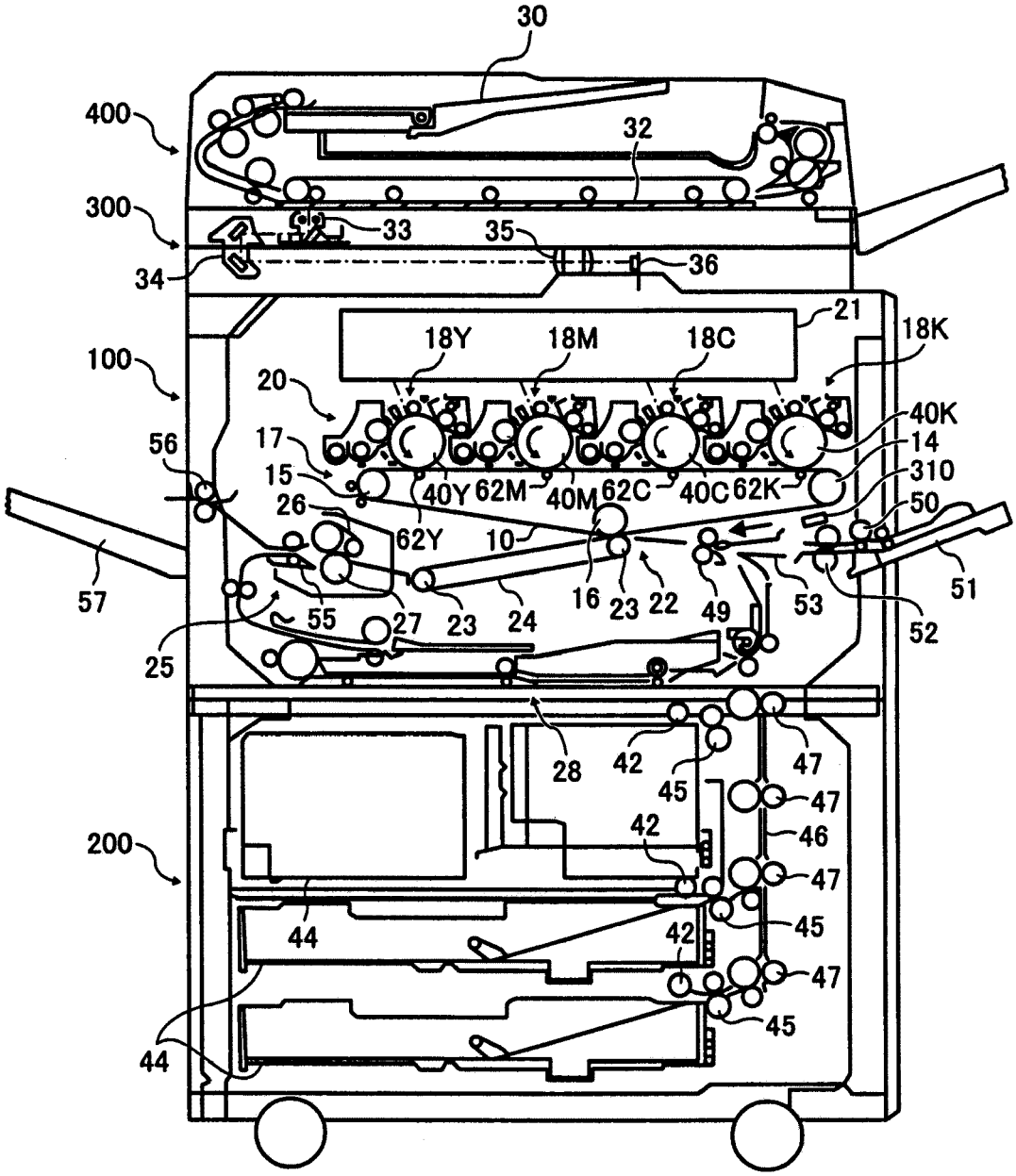
FIG. 1 is a copier as one example of an image forming apparatus according to one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIGS. 8, 9, 10, 11 and 24, gradation patterns according to exemplary embodiments of the present invention are described.

FIG. 1 illustrates a copier as one example of an image forming apparatus according to one exemplary embodiment of the present invention. The copier includes a main body 100, a paper feed table 200, a scanner 300, and an auto document feeder (ADF) 400. The main body 100 is placed on the paper feed table 200. The scanner 300 is attached to the main body 100, and the auto document feeder (ADF) 400 copier is placed on the scanner 300. The copier is a tandem-type electrophotographic copier that employs an intermediate transfer (indirect transfer) method.

In the middle of the main body 100, an intermediate transfer belt 10 that is an intermediate transfer member as a secondary image carrier is provided. The intermediate transfer belt 10 is extended among three support rollers 14, and 16. The support rollers 14, 15 and 16 are support rotators and move rotating in a clockwise direction. At left side of the second support roller 15 that is one of the three support rollers 14, 15 and 16 shown in FIG. 1, a cleaning device 17 that removes residual toner attached to the intermediate transfer belt 10 after image transfer process is provided.

At a portion of the intermediate transfer belt 10 extended among the first and second support rollers 15 and 16, a tandem image forming unit 20 is provided along a movement direction of the intermediate transfer belt 10 to face the portion of the intermediate transfer belt 10. The tandem image forming unit 20 includes four image forming units 18 for yellow (Y), magenta (M), cyan (C) and black (K) colors that are arranged in series. In this exemplary embodiment, the third support roller 16 is a drive roller. Further, an exposure device 21 is provided as a writing means above the tandem image forming unit 20.

At the other side of the tandem image forming unit 20 via the intermediate transfer belt 10 a secondary transfer device 22 is provided as a secondary transfer device. In the secondary transfer device 22, a secondary transfer belt 24 is extended among two rollers 23 as a recording medium conveyance means. The secondary transfer belt 24 is provided to be pressed to the third support roller 16 via the intermediate transfer belt 10. An image on the intermediate transfer belt 10 is transferred onto a sheet that is the recording medium by the secondary transfer device 22.

At left side of secondary transfer device 22 in FIG. 1, a fixing device 25 is provided to fix the image transferred onto the sheet. In the fixing device 25, a pressure roller 27 is provided to be pressed to a fixing belt 26. The above-described secondary transfer device 22 has a mechanism to convey the sheet to the fixing device 25 after image transfer process. The secondary transfer device 22 can include a transfer roller and a non-contact type charger if necessary. However, it becomes difficult to perform sheet conveyance when the transfer roller and the non-contact type charger are employed. In this exemplary embodiment, underneath the secondary transfer device 22 and the fixing device 25, and parallel to the above-described tandem image forming unit 20, a sheet-inverting device 28 is provided to invert the sheet to form images on both sides of the sheet.

To make a copy of a document using the copier, the document to be copied is placed on a document table 30 of the auto document feeder 400. Alternatively, the auto document feeder 400 is opened and the document is placed on a contact glass 32 of the scanner 300. Then, the auto document feeder 400 is closed and the document is pressed by the auto document feeder 400. After that, when the document is set in the auto document feeder 400, the sheet is fed by the auto document feeder 400 and is conveyed to the contact glass 32 by pressing a start switch, not shown.

On the other hand, when the document is set on the contact glass 32, the scanner is driven immediately. After that, a first and second running members 33 and 34 are moved. A light source on the first running member 33 emits light and reflects a reflected light from the document to the second running member 34. The light is reflected by a mirror at the second running member 34 and is introduced to reading sensor 36 through an imaging lens 35 to read the document.

In parallel with the document reading process, a drive roller 16 is driven to rotate by a drive motor that is a drive source, not shown. The intermediate transfer belt 10 is moved in a clockwise direction in FIG. 1. The other two support rollers 14 and 15 are driven to rotate in accordance with the movement. At the same time, each photosensitive drum 40Y, 40M, 40C and 40K that is an image carrier is rotated at each image forming unit 18. A single color toner image is formed on each photosensitive drum 40Y, 40M, 40C and 40K by exposing and developing based on each color information, i.e., yellow, magenta, cyan and black colors. The toner images on the photosensitive drum 40Y, 40M, 40C and 40K are transferred successively onto the intermediate transfer belt 10 to superimpose to each other. As a result, a superimposed color image is formed on the intermediate transfer belt 10.

In parallel with the image forming process described above, sheets are fed from one of paper cassettes 44 by selectively driving to rotate one of paper feed rollers 42 of the paper feed table 200. A separation roller 45 performs sheet separation and sends one sheet to a paper conveyance path 46. The sheet drawn out is conveyed by a conveyance roller 47, is fed into a conveyance path of the main body 100, and is stopped by striking against a resist roller 49. Alternatively, sheets in a manual paper feed tray 51 are fed by rotating a paper feed roller 50. A separation roller 52 performs sheet separation and sends one sheet to a manual paper conveyance path 53. The sheet drawn out is conveyed, and is stopped by striking against a resist roller 49. The resist roller 49 is driven to rotate at a timing to match the superimposed color image on the intermediate transfer belt 10. The sheet is fed to a position between the intermediate transfer belt 10 and the secondary transfer device 22. Then, color image is transferred onto the sheet by the secondary transfer device 22.

After the above-described transfer process, the paper is conveyed by the secondary transfer belt 24 and is sent to the fixing device 25. The transferred image is fixed with heat and pressure at the fixing device 25. The sheet is output by an output roller 56 after a switching pawl 55 switches a paper-feed path and discharged to an output paper tray 57. Alternatively, the sheet is sent to the sheet-inverting device 28 after a switching pawl 55 switches the paper-feed path, is inverted, and is sent to the transfer position again. The image is then recorded at a backside of the paper, and is output by the output roller 56.

After the image transfer process, the residual toner attached to the intermediate transfer belt 10 is removed to prepare for a succeeding image forming process performed at the tandem image forming unit 20. The resist roller 49 is generally grounded. However, the resist roller 49 may be biased to remove paper particles.

The image forming unit 18 of the tandem image forming unit 20 will now be described in greater detail. The image forming unit 18K for the color black will now be described here, as representative of all four image forming units.

Figure 2:
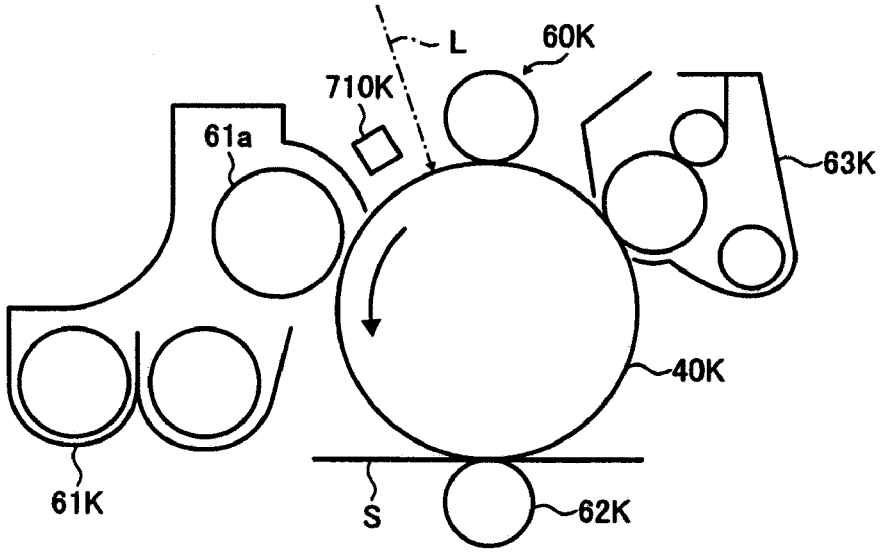
FIG. 2 is a magnified view of an image forming unit of the copier.

FIG. 2 is a magnified view of an image forming unit of the copier. The other image forming units for Y, M, and C color have structures identical to that of the image forming unit 18K. As shown in FIG. 2, the image forming unit 18K includes a charging device 60K, a voltage sensor 710K, a developing device 61K, a photoreceptor-cleaning device 63K, and a neutralization apparatus, not shown, around a photoreceptor 40*k* having a drum shape.

During the image forming process, the photoreceptor 40*k* is driven to rotate by a drive motor, not shown. The photoreceptor 40*k* is uniformly charged by the charging device 60K, is exposed by a writing light L from the exposure device 21, and holds an electrostatic latent image. A color image signal from the scanner 300 is processed with image processing processes such as color translation at an image processing unit, not shown. The color image signal is output to the exposure device 21 as each color signal K, Y, M, and C.

The exposure device 21 translates an electric signal of a K-image from the image processing unit to a light signal, and forms an electrostatic latent image by scanning and exposing the light on the photoreceptor 40*k* based on the light signal.

A bias voltage is applied to a development roller 61*a* that is a development member of the developing device 61K, such that a bias potential that is a voltage difference is formed between the electrostatic latent image and the development roller 61*a*. The toner on the development roller 61*a* moves from the development roller 61*a* onto the electrostatic latent image by the bias potential. As a result, the electrostatic latent image is developed to form a toner image. The K-toner image formed on the intermediate transfer belt 10 is transferred to transfer paper S by a primary transfer device 62*k*. In the photoreceptor 40*k*, residual toner is removed by the photoreceptor cleaning device 63K after the toner image transfer process. The photoreceptor 40*k* is then neutralized to prepare for the succeeding image formation.

Similarly, the image forming units 18Y, 18M, and 18C includes a charging device, a developing device, a photoreceptor-cleaning device and a neutralization apparatus around the photoreceptor 40Y, 40M and 40C having a drum shape. Toner images of Y, M, and C colors are formed on the photoreceptor 40Y, 40M, and 40C, respectively, and primarily transferred to the intermediate transfer belt 10 by successive superimposition.

The image forming apparatus according to the exemplary embodiment performs in full color and monochrome modes. In the full color mode, all the photoreceptor 40Y, 40M, 40C, and 40K touch the surface of the intermediate transfer belt 10. In the monochrome mode, the photoreceptors 40Y, 40M, 40C other than the photoreceptor 40K are separated from the surface of the intermediate transfer belt 10 while only black is processed.

Further, the image forming apparatus according to the exemplary embodiment includes an auto-color-change mode. In the auto-color-change mode, the image forming apparatus detects a color document image read by the scanner and changes a mode-setting to the full color mode or the monochrome mode.

Further, as for the monochrome mode, there are two monochrome modes, a first and a second. In the first monochrome mode, image forming is performed by separating the other photoreceptors 40Y, 40M, and 40C from the intermediate transfer belt 10 except for the photoreceptor 40K. In the second monochrome mode, image forming is performed by stopping operation of the other photoreceptors 40Y, 40M, 40C. The second monochrome mode is executed only when the auto-color-change mode is selected.

The image forming apparatus according to the exemplary embodiment further includes an input unit such that a user can set the mode, i.e., the monochrome mode, the full color mode, or the auto-color-change mode. The input unit is provided on an operation panel that is a manual operation procedure, not shown.

The manual setting provides the following advantages: When the user wants to change the color type from an original full color image to a monochrome image, the user can obtain a desired monochrome image by operating the operation panel to select the monochrome mode. Further, it is possible to reduce deterioration of the photoreceptors 40Y, 40M, and 40C because the photoreceptors 40Y, 40M, and 40C are always located at separated positions from the intermediate transfer belt 10 in the monochrome mode.

In the auto-color-change mode, it is possible to change to the monochrome mode. However, the operational mode can not be changed to the monochrome mode when the user selects the full color mode. As a result, when a plurality of documents that include color image and monochrome documents are to be printed, printing speed is faster than a printing speed at the auto-color-change mode. Accordingly, the user can get a plurality of print images of the documents that include color image and monochrome documents more quickly.

The image forming apparatus according to the exemplary embodiment performs an image concentration control to optimize each color image concentration at power-on and at every printing operation of a predetermined numbers of sheets. In this image concentration control, toner patches are formed on each photoreceptor 40Y, 40M, 40C, and 40K. The toner patches formed on each photoreceptor 40Y, 40M, 40C, and 40K are formed of a gradation pattern that comprises a plurality of toner patches. Specifically, line patterns are formed on a surface of the photoreceptor along the moving direction of the photoreceptor. Among the line patterns, a toner adhesive amount is changed gradually.

The gradation pattern formed on each photoreceptor 40Y, 40M, 40C, and 40K is transferred onto the intermediate transfer belt 10, and is detected by a light sensor 310 that is a light detection means and is provided at a position facing the intermediate transfer belt 10 as shown in FIG. 1. Then, the toner adhesive amount (toner concentration) is calculated based on a detected value detected by the light sensor 310 with a predetermined adhesive algorithm.

Based on the relation between the toner adhesive amount (toner concentration) and an operation condition (development potential), development value γ and development-start voltage Vk are obtained. The development value γ is a slope angle and the development-start voltage Vk is an intercept, where a horizontal axis represents the development potential and a vertical axis represents the toner adhesive amount. Based on the development value γ, an exposure power (writing intensity), a charging bias, and a development bias are adjusted to become a development potential having an appropriate toner adhesive amount.

A configuration of the light sensor 310 in this embodiment will now be described in greater detail.

Figure 3:
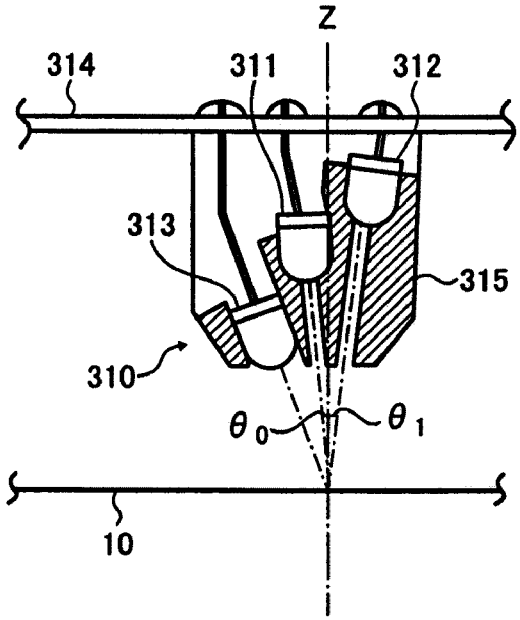
FIG. 3 is a cross-sectional view of a light sensor used in the copier.

FIG. 3 is a cross-sectional view of the configuration of the light sensor 310. The light sensor 310 includes a light emitting device 311, a regular-reflection light-sensitive device 312 and a diffuse-reflection light-sensitive device 313. The light emitting device 311 is a light emitting means, the regular-reflection light-sensitive device 312 is a first light-sensitive device to receive the regular-reflection light, and the diffuse-reflection light-sensitive device 313 is a second light-sensitive device to receive diffuse-reflection light. Each device 311, 312 and 313 is assembled on a printed board 314 and is enclosed in a single package 315.

In the package 315, an incident light path and a regular-reflection light path are formed. Incident light emitted from the light emitting device 311 passes through the incident light path and arrives at the surface of the intermediate transfer belt 10. Regular-reflection light regularly reflected at the intermediate transfer belt 10 passes through the regular-reflection light-sensitive device 311.

Sensitivity adjustment of the light sensor 310 is necessary to maintain reliable and accurate detection of the toner adhesive amount that may change due to output power deviation of emitting elements, characteristic deviation of emitting devices among lots, temperature characteristics, aging of light-sensitive elements, and aging of the intermediate transfer belt.

In this exemplary embodiment, output value of the gradation pattern detected by the light sensor 310 is adjusted (corrected) based on the detected value of the gradation pattern detected by the light sensor 310 by performing a following light-sensor correction control to correct the sensitivity of the light sensor 310.

The light-sensor correction control of the exemplary embodiment will now be described. Notations used in the following description are listed below, together with their definitions.

Vsg: output voltage at background portion of the transfer belt

Vsp: output voltage at each pattern portion

Voffset: offset (output voltage at LED_OFF)

_reg.: regular-reflection light output (short form of Regular Reflection)

_dif.: diffuse-reflection light output (short form of Diffuse Reflection)

(cf. JISZ8105: refer to terms related to color)

[n]: number of elements, array variable of n (number of toner patches)

[STEP 1] data sampling: calculation of Vsp and ΔVsg.

In step 1, differences from offset voltage are calculated for all points [n] in regular-reflection and diffuse-reflection light outputs using the following formulas (1) and (2):

$$\Delta Vsp_reg.[n]=Vsp_reg.[n]-V\text{offset}_reg \quad (1)$$

$$\Delta Vsp_dif.[n]=Vsp_dif.[n]-V\text{offset}_dif \quad (2)$$

[STEP 2] calculation of sensitivity correction coefficient α.

In step 2, ΔVsp_reg.[n]/ΔVsp_dif.[n] is calculated at each point based on ΔVsp_reg.[n] and ΔVsp_dif.[n] obtained by the STEP 1. The coefficient α by which the diffuse-light output (ΔVsp_dif.[n]) is multiplied when the regular-reflection light output is broken down at STEP 3 is determined using the following formula 3:

$$\alpha=\min(\Delta Vsp_reg.[n]/\Delta Vsp_dif.[n] \quad (3)$$

[STEP 3] breakdown of the regular reflection light output:

In step 3, the regular-reflection light output is broken down by formulas (4) and (5):

$$\Delta Vsp_reg._dif.[n]=Vsp_dif.[n]\times\alpha \quad (4)$$

$$\Delta Vsp_reg._reg.[n]=Vsp_\text{reg.}_dif.[n]-\Delta Vsp_reg._dif.[n] \quad (5)$$

[STEP 4] normalization of the regular-reflection light output versus regular-reflection element:

In step 4, a ratio between the output voltage at each pattern portion and the output voltage at background portion of the transfer belt is determined and is translated to normalization values that are from 0 to 1:

$$\beta[n]=\Delta Vsp_reg._reg.[n]/\Delta Vsp_reg._reg.[n] \text{(=exposure rate of the background portion of the transfer belt)} \quad (6)$$

[STEP 5]: deviation correction on the background portion of the diffuse-light output.

In step 5, removing process is performed to remove an element [diffuse-light output element from the belt background portion] from [diffuse light output voltage]. The processing formula for diffuse-light output after correction is as follows:

$$\Delta Vsp_dif.'=\text{[diffuse-light output]}-\text{[output of the belt background portion]}\times\text{[normalization value of the normalization element]}=Vsp_dif(n)-Vsg_dif\times\beta(n) \quad (7)$$

[STEP 6]: sensitivity adjustment of the diffuse-light output.

In step 6, diffuse-light outputs after deviation correction on the background portion of the diffuse-light output are plotted with respect to the normalization value of the regular-reflection light (regular-reflection element). A sensitivity of the diffuse light is obtained by determining an approximate line. The sensitivity is adjusted to become a predetermined target sensitivity.

To determine the approximate line, there are two methods, i.e., linear approximation (primary approximation) [process-1] and polynomial approximation (secondary approximation) [process-2].

[Process-1]

In the process-1, a sensitivity correction coefficient η is calculated from a linear relation on a linear region of the plotted line (β value(n), 0.30 to 0.90) that is obtained from plots of the diffuse-light outputs after deviation correction on the background portion of the diffuse light output. Slope angle of the linear plot line is determined by method of least squares:

$$= \frac{\sum (x[i]-X)(y[i]-Y)}{\sum (x[i]-X)^2} \quad (8)$$

$$y \text{ intercept}/Y-(\text{slope angle of linear line})*/X,$$

where x[i]: the regular-reflection light versus the normalization value of regular-reflection element, X: the regular-reflection light versus average of the normalization value of regular-reflection element, y[i]: diffuse-light outputs after deviation correction on the background portion, Y: average of the diffuse-light outputs after deviation correction on the background portion, and x range used for calculation is 0.30=<x=<0.90.

In this exemplary embodiment, lower limit of the x range used for calculation is 0.30, however, any value within a range having a linear relation of x and y can be employed. On the other hand, upper limit of 0.9 is determined to reject a deviation error due to a belt damage. The upper limit of 0.9 is close to the 1.0 that corresponds to a situation in which the toner may not attach and cause belt damage.

The sensitivity correction coefficient η is obtained such that a normalization value "a" calculated with the primary expression becomes a predetermined value "b".

$$\eta=b/(\text{slope angle of linear line}*a+y \text{ intercept}) \quad (9)$$

[Process-2]

In the process-2, a sensitivity correction coefficient η is calculated by a polynomial approximation (quadratic expression in this embodiment) on the plotted line that is obtained from plots of the diffuse light outputs after deviation correction on the background portion of the diffuse light output. The sensitivity correction coefficients ξ1, ξ2 and ξ3 are determined by approximating the plot line using the secondary approximation equation ($y=\epsilon 1x^2+\epsilon 2x+\epsilon 3$) with method of least squares, formula (10):

$$\xi_1\sum_{i=1}^{m} x[i]^2+\xi_2\sum_{i=1}^{m} x[i]^1+\xi_3\sum_{i=1}^{m} x[i]^0=\sum_{i=0}^{m} y[i]x[i]^0 \quad (1)$$

$$\xi_1\sum_{i=1}^{m} x[i]^3+\xi_2\sum_{i=1}^{m} x[i]^2+\xi_3\sum_{i=1}^{m} x[i]^1=\sum_{i=0}^{m} y[i]x[i]^1 \quad (2)$$

$$\xi_1\sum_{i=1}^{m} x[i]^4+\xi_2\sum_{i=1}^{m} x[i]^3+\xi_3\sum_{i=1}^{m} x[i]^2=\sum_{i=0}^{m} y[i]x[i]^2 \quad (3)$$

where m: data number, x[i]: the regular-reflection light versus the normalization value of regular-reflection element, y[i]: diffuse light outputs after deviation correction on the background portion, and x range used for calculation is 0.06=<x=<0.90.

The sensitivity correction coefficients ϵ1, ϵ2 and ϵ3 are obtained by solving simultaneous equations (1), (2) and (3).

In this exemplary embodiment, a lower limit of the x range used for calculation is 0.06 and an upper limit is 0.90. However, any value can be employed. The upper limit may be determined to be a value for avoiding an effect by the background deviation. The sensitivity correction coefficient η is obtained such that a normalization value "a" calculated with the primary expression becomes a predetermined value "b" using the following formula (11):

Sensitivity Correction Coefficient:

$$\eta=\frac{b}{\xi_1 a^2+\xi_2 a+\xi_3} \quad (11)$$

The diffuse-light output after deviation correction on the background portion is corrected by multiplying the sensitivity correction coefficient η obtained at the process-1 and process-2 such that the relation between the adhesive amount and the diffuse-light output becomes a predetermined relation, i.e., the diffuse-light output after sensitivity correction: ΔVsp_dif". Thus:

Diffuse-Light Output After Sensitivity Correction:

$$\Delta Vsp_dif''=\text{[diffuse-light output after deviation correction on the background portion]}\times\text{[sensitivity correction coefficient: }\eta\text{]}=\Delta Vsp_dif''(n)\times\eta \quad (12)$$

The foregoing description is the adjustment (correction) control (processing) of the light sensor output against the change of the light sensor due to aging that the LED light amount drops. After adjusting (correcting) output value of the light sensor 310, the output value of the light sensor 310 is transferred to a toner adhesive amount referring to an adhesive amount translation table based on the output value of the light sensor 310.

The image forming apparatus according to the exemplary embodiment employs two controlling methods using detection results of the gradation pattern of the light sensor 310, i.e., the above-described image concentration control and the sensitivity adjustment (correction) control of the light sensor performed as a preprocessing before the image concentration control. Generally, a gradation pattern comprised of 10 to 16 toner patches is formed at each color for performing these two controls. For this reason, the number of toner patches becomes a large number such as 40 to 52, a necessary length for the toner patches increases, and a long toner detection time is needed. Further, a lot of toner is consumed and wasted. In this exemplary embodiment, the above-described image concentration control and sensitivity correction control are performed while the number of patches is reduced.

In the image concentration control, the detection results of the gradation pattern detected by the light sensor 310 is used to calculate the development value γ. In the sensitivity correction control for the light sensor 310, the detection results of the gradation pattern of the light sensor 310 is used to calculate the sensitivity correction coefficients α and η.

A necessary number of toner patches of the gradation pattern is now considered to calculate each coefficient (development value γ, sensitivity correction coefficients α and η).

The necessary conditions for calculation of the sensitivity correction coefficient α are described below.

The sensitivity correction coefficient α is a minimum value of the ratio of regular-reflection light output (ΔVsp_reg) and diffuse-reflection light output (ΔVsp_dif). Therefore, a plurality of data points around the minimum value is necessary to search the minimum value successfully. Specifically, on the calculation of the sensitivity correction coefficient α, a plurality of toner patches each of which has different adhesive amount to output similar output value close to the minimum value is necessary.

The necessary conditions for calculation of the sensitivity correction coefficient η are as follows.

The sensitivity correction coefficient η is a correction coefficient to multiply so as to match the relation between the diffuse-light output at a detection of the gradation pattern and the toner adhesive amount with the relation of the adhesive translation table. At least two data points are enough in the effective range of β[n] when the sensitivity correction coefficient η is obtained using the linear approximation (primary approximation) as the process-1. At least data points of order of +1 of the approximation equation are enough in the effective range of β[n], when the sensitivity correction coefficient η is obtained using the polynomial approximation (secondary approximation) as the process-2. For the polynomial approximation, it may be desired to employ the secondary approximation equation to simplify calculation accuracy.

When the number of data points for calculating the sensitivity correction coefficient η is determined, following factors are to be considered.

*) data points at lower adhesive amount may have deviation due to error factors such as belt damage,

*) As for the development performances (development value γ, development-start voltage Vk), the development value γ is a characteristic to be controlled. However, the development-start voltage Vk is just a subsidiary characteristic resulting from the change of the development value γ. When the image forming condition of the gradation pattern is a fixed condition (fixed potential), the patch concentration may be changed due to the change of the development-start voltage Vk.

To reduce the effect due to the error factors such as unexpected data, verification is conducted at each image forming apparatus by experiments, etc., and redundancy data may be added to the minimum data number as necessary.

A toner patch number for the image concentration control and the light sensor correction control is verified. The tandem-type image forming apparatus shown in FIG. 1 is used for the verification. The light sensor 310 provided at a position to face the intermediate transfer belt 10 employs a monochrome light sensor 310K for black and white, and color light sensors 310Y, 310M and 310C for other colors (Y, M, and C) as shown in further figure of FIG. 19. The monochrome light sensor 310K is a light sensor that only receives regular-reflection light. Each color light sensor 310Y, 310M and 310C is a light sensor that receives regular-reflection light and diffuse-reflection light. The monochrome light sensor 310K performs correction for the light sensor based on the detection value at the detection of the background portion of the belt.

Figure 4A:
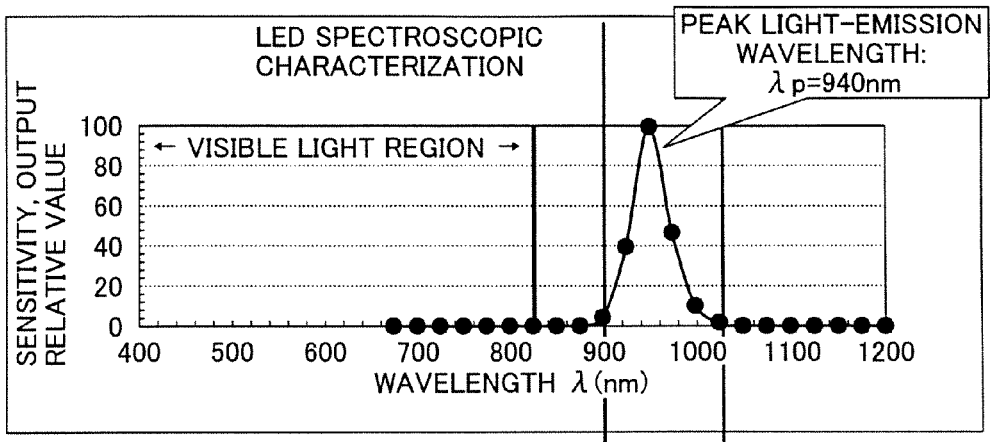
FIGS. 4A and 4B are graphs representing spectral sensitivity characteristics of an emitting light device and a receiving light device of the light sensor, respectively.
Figure 4B:
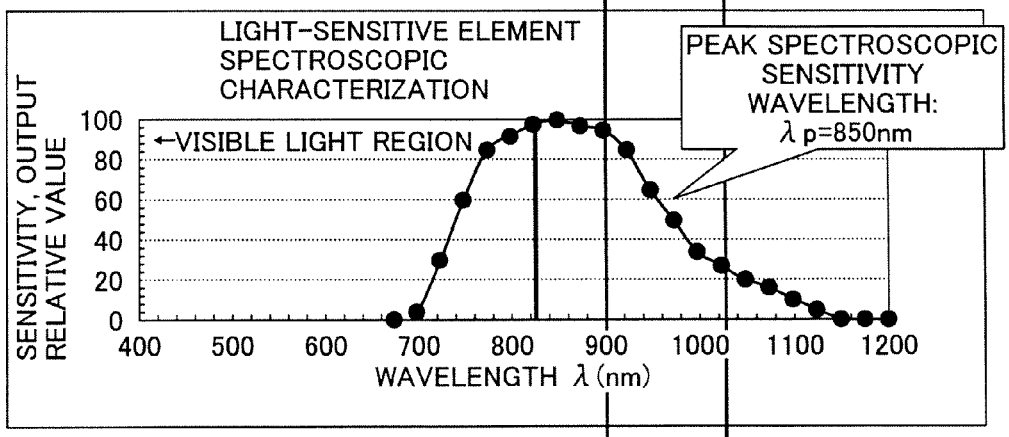
Figure 4C:
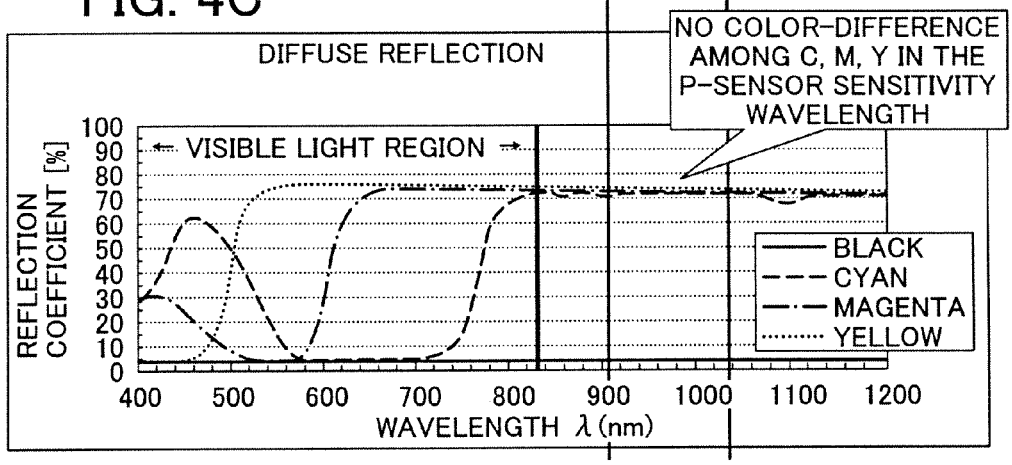
FIG. 4C is a graph representing spectral sensitivity characteristic of Y, C, and M color toner.

The color light sensor 310Y, 310M and 310C includes a GaAs light emitting diode as a light emitting device 311, and Si photo transistors as the regular-reflection light receiving device 312 and the diffuse-reflection light receiving device 313. The GaAs light emitting diode has a peak emission wavelength of 940 nm as shown in FIG. 4A. The Si photo transistors have a peak spectroscopic sensitive wavelength of 850 nm as shown in FIG. 4B. Specifically, the light sensor 310 detects infrared rays having a wavelength of longer than 830 nm that causes no significant difference in reflection rate as shown in FIG. 4C. The expression "no significant difference" means that deviation among three colors is within 3%. At the wavelength 830 nm, the reflection rate is 71.68 nm for C-color, 73.96 nm for M-color, 76.22 nm for Y-color. The average value and range are 73.95 [+−2.27], respectively. Specifically, one side of deviation width about the wavelength 830 nm is expressed by (2.27/73.95*100%) and is approximately 3%. At other wavelength of large than 830 nm, the reflection rate is around above-described value and the deviation among three colors is within 3%.

The light sensor to be considered below is a color light sensor.

Image Forming Condition of Gradation Pattern

The image forming condition of gradation pattern is shown in the following.

*) toner patch number: P1-P10

*) target value of development value γ

: black (development value γ=1.25 [mg/cm$^2$/−kV])

: color CMY commonly (development value γ=1.50 [mg/cm$^2$/−kV])

*) bias condition: fixed voltage (charging DC=−700[V], development DC=−500[V])

*) exposure condition: LD power=fixed, on-duty of LD=refer to Table 1 (each color commonly)

TABLE 1

| Write value table | | |
|---|---|---|
| | Color | Bk |
| P1 | 19% | 24% |
| P2 | 25% | 32% |
| P3 | 33% | 40% |
| P4 | 44% | 48% |
| [for η calculation] | | |
| P5 | 56% | 56% |

TABLE 1-continued

| Write value table | | |
|---|---|---|
| | Color | Bk |
| P6 | 67% | 63% |
| P7 | 78% | 71% |
| P8 | 89% | 79% |
| P9 | 94% | 89% |
| P10 [for α calculation] | 100% | 100% |

Specifically, when each toner patch is formed, different development potentials are formed by making the on-duty of LD different such that concentration value of each toner patch is different.

Calculation of Development Value γ

Figure 5:
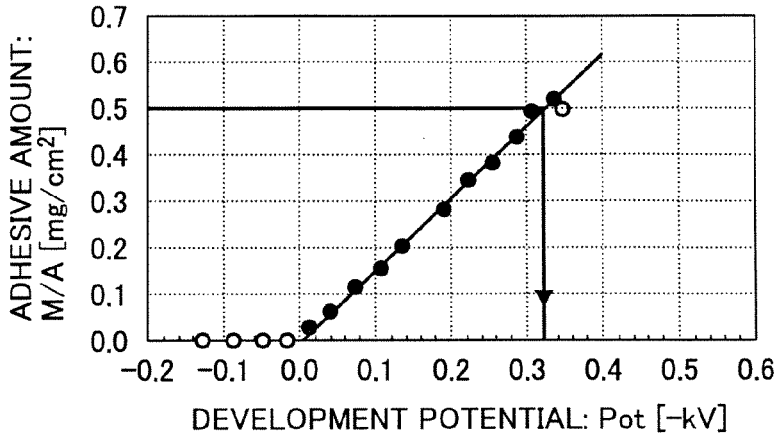
FIG. 5 is a graph representing a toner adhesive amount characteristic versus development potential.

FIG. 5 is a graph representing a relation between toner adhesive amount calculated based on detection values of 10 toner patches detected by the light sensor, and development potential at image forming of each toner patch. As shown in FIG. 5, the relation has a clear linearity in a range of the toner adhesive amount used for calculation of the development value γ. Accordingly, 10 data points are not necessary but fewer data points are enough to calculate the development value γ, if an acceptable level is defined on deviation of the image concentration to obtain a requested quality with respect to individual image forming apparatus.

In this exemplary embodiment, the development device for each color can have a linear characteristic with a small deviation as shown in FIG. 5. At least two patches that correspond to the concentrations are enough to calculate the development value γ.

There are two possible deviations of toner adhesive amounts due to mechanical factors. Specifically, the toner adhered amount to the toner patch is changed due to uneven repetition of development sleeves, and due to error with respect to output value from the regular-reflection receiving device including deviation of output value itself. The error with respect to output value is caused by partial damage to the surface of the transfer belt.

Redundant patches may be formed as required. It is not suitable for the system in terms of toner consumption, but it contributes to reduce error factors. When the necessary number of patches for the sensitivity correction coefficient α, η described later is equal to and more than three, it can be achieved to reduce the toner consumption by taking an appropriate number of patches having an effective balance in addition to making the calculation of sensitivity correction coefficient possible.

Calculation of Sensitivity Correction Coefficient α

Figure 6:
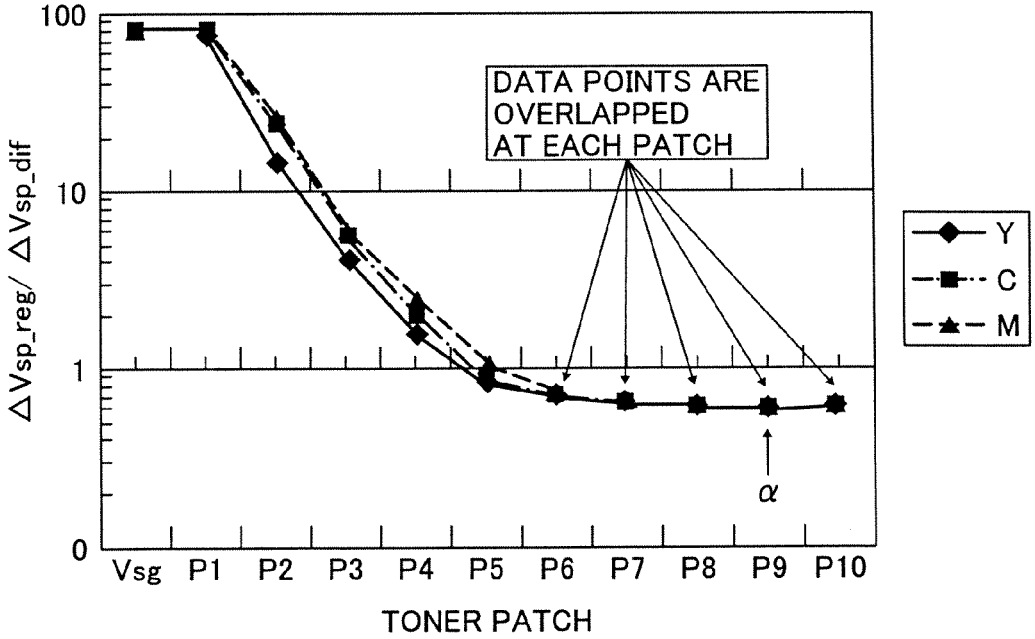
FIG. 6 is a graph of a relation between (regular reflection light output ((ΔVsp_reg)/diffuse reflection light output (ΔVsp_dif)) and individual toner patches.

FIG. 6 is a graph representing a relation between the ratio of the regular-reflection light output (ΔVsp_reg) and diffuse-reflection light output (ΔVsp_dif), and the toner patch number. As shown in FIG. 6, identical number is obtained among each color around the minimum value of the sensitivity correction coefficient α that is the ratio of the regular-reflection light output (ΔVsp_reg) and diffuse-reflection light output (ΔVsp_dif). The region around the minimum value of the sensitivity correction coefficient α correspond to high concentration portion of the toner patches P8, P9 and P10. This is because the light sensor is a sensor dedicated to detect infrared and near-infrared light rays that do not have much difference in color reflection rate. Further, image forming conditions such as target development value γ, fixed voltage value, and LD on-duty, to form the gradation patterns for Y, M, and C colors are jointly controlled such that the concentration of each toner patch for each color becomes identical.

The sensitivity correction coefficient α is determined as the minimum value of the ratio of the regular-reflection light output (ΔVsp_reg) and diffuse-reflection light output (ΔVsp_dif). Therefore, plural data points having identical value are not necessary but data points are needed to be uniformly distributed around the minimum value of the ratio of the regular-reflection light output (ΔVsp_reg) and diffuse-reflection light output (ΔVsp_dif). Using the light sensor dedicated to detect lights such as infrared rays that does not have much difference in the reflection rate, one color toner patch of the gradation patterns P8, P9 and P10 among Y, M, and C color at high concentration region is enough to calculate the sensitivity correction coefficient α.

Calculation of Sensitivity Correction Coefficient η

Figure 7:
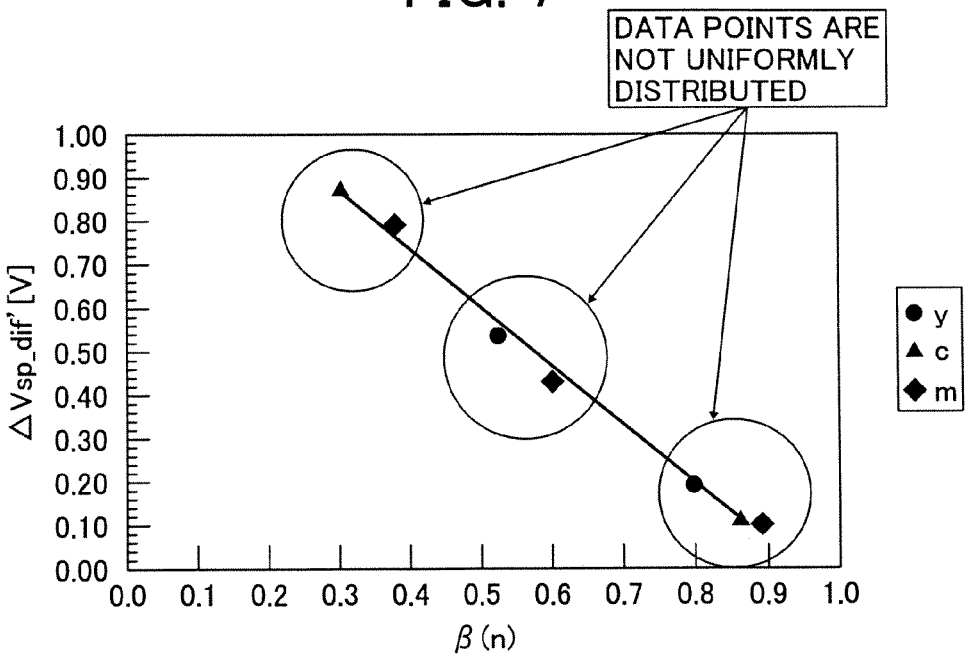
FIG. 7 is a graph representing a relation between normalization value of regular reflection element at calculation of a sensitivity correction coefficient η, and diffuse light output ΔVsp_dif' after correction.

FIG. 7 is a graph in which detection values of toner patches in an effective data region of β (0.3 to 0.9) are plotted. The toner patches in the effective data region of β[n] to determine the sensitivity correction coefficient η are the toner patches P2, P3 and P4 shown in Table 1. The β[n] and ΔVsp_dif of each color in the effective data region are shown in Table. 2.

TABLE 2

| | β (n) | Δ Vsp_dif |
|---|---|---|
| P02 (Y) | 0.801 | 0.190 |
| P03 (Y) | 0.525 | 0.534 |
| P02 (C) | 0.864 | 0.107 |
| P03 (C) | 0.603 | 0.450 |
| P04 (C) | 0.302 | 0.885 |
| P02 (M) | 0.893 | 0.095 |
| P03 (M) | 0.603 | 0.420 |
| P04 (M) | 0.379 | 0.781 |

As Referred to FIG. 7, the light sensor dedicated to detect lights such as infrared rays that does not have much difference in the reflection rate is used, and image forming conditions such as, target development value γ, a fixed voltage value, and a LD on-duty, to form the gradation patterns for Y, M, and C colors are jointly controlled such that the concentration of each toner patch for each color becomes identical value. Accordingly, data points for each color are not distributed and are approximately identical. Meanwhile, focusing on, for example, C-color, C-color plots are uniformly distributed.

To calculate the sensitivity correction coefficient η, it is desirable that data points detected from the toner patches be uniformly distributed in the effective data range (in which normalization value β[n] has a linear relation with ΔVsp_dif at the primary approximation, and in which regular-reflection output does not become saturated at the secondary approximation). For this reason, using the light sensor dedicated to detect light such as infrared, which does not have much difference in the reflection rate, one color toner patch of the gradation pattern among Y, M, and C color at low concentration region P2, P3 and P4 is enough to calculate the sensitivity correction coefficient η. If toner patches P2, P3 and P4 are formed of the one color gradation patterns at low concentration region, it is possible to distribute the data points uniformly in the effective data range.

Based on the above-described consideration, it can be said that:

1. At least two toner patches are enough to calculate the development value γ for each color. However, it is desirable to have equal to and more than two toner patches in consideration of the deviation of the toner adhesive amounts due to the mechanical factors;

2. Using the light sensor dedicated to detect lights such as, infrared rays that does not have much difference in the reflection rate, one color toner patch of the gradation patterns P8, P9 and P10 among Y, M, and C color at high concentration region is enough to calculate the sensitivity correction coefficient α; and 3. Using the light sensor dedicated to detect light such as infrared, which does not have much difference in the reflection rate, one color toner patch of the gradation patterns among Y, M, and C color at low concentration region P2, P3 and P4 is enough to calculate the sensitivity correction coefficient η.

Figure 8:
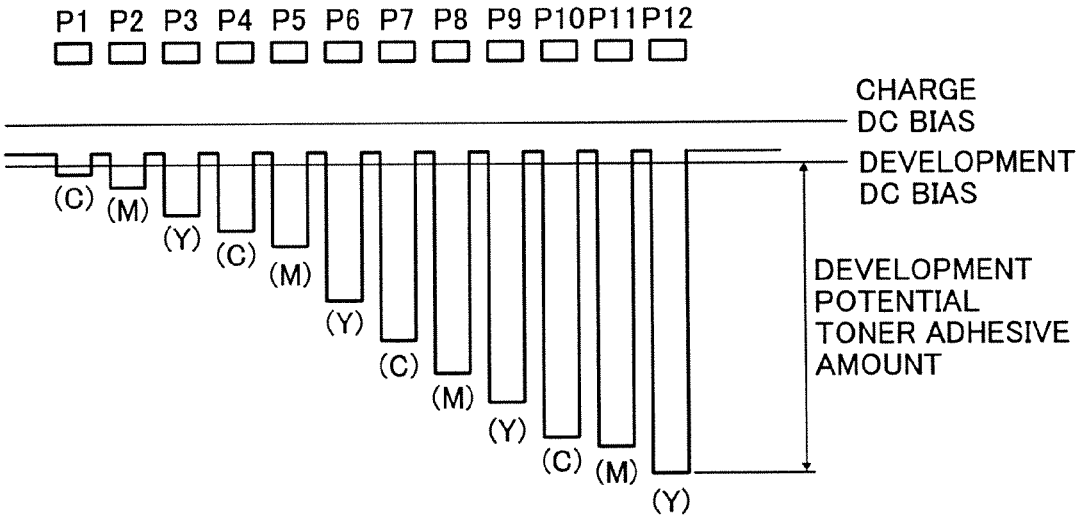
FIG. 8 is an example of a gradation pattern according to the exemplary embodiment.
Figure 13:
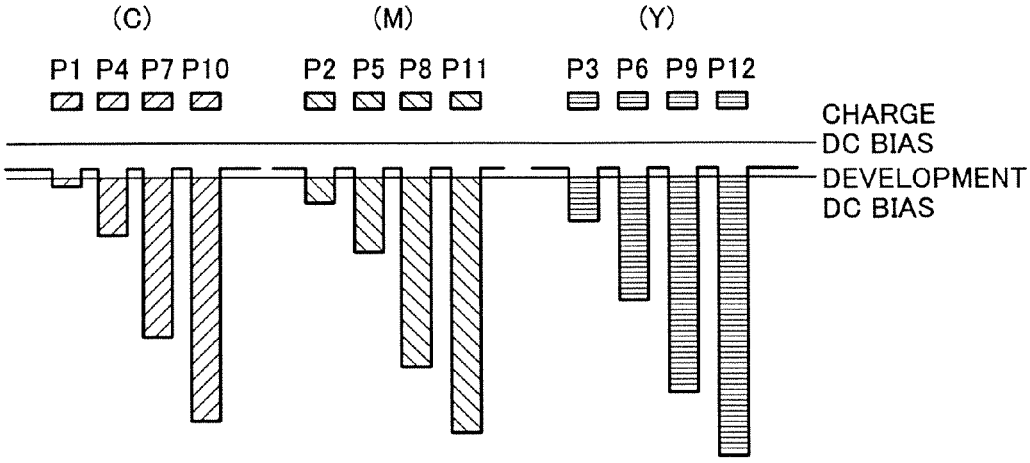
FIG. 13 is a schematic representing a toner adhesive amount at each toner patch.

As described above, it is possible to calculate the sensitivity correction coefficients α and η by forming one gradation pattern having a plurality of color toner patches with different adhesive amounts among Y, M, and C colors, when the light sensor dedicated to detect light such as infrared that does not have much difference in the reflection rate is used. Specifically, for example, as for a gradation pattern that comprises 12 toner patches formed with an image forming condition (development potential) to have different adhesive amounts as shown in FIGS. 8 and 13, the toner patches P1, P4, P7 and P10 are formed of C-color, referring to FIG. 13. Further, the toner patches P2, P5, P8 and P11 are formed of M-color, referring to FIG. 13. Furthermore, the toner patches P3, P6, P9 and P12 are formed of Y-color, referring to FIG. 13.

Figure 18:
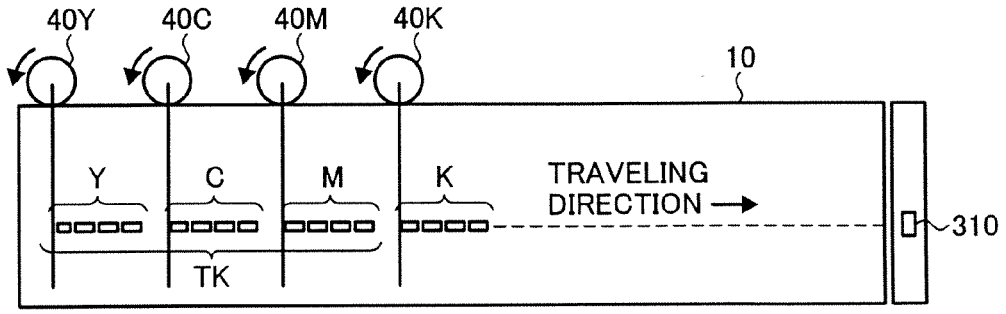
FIG. 18 is a schematic representing a transfer process of transferring the gradation pattern according to the exemplary embodiment to a transfer belt.
Figure 23:
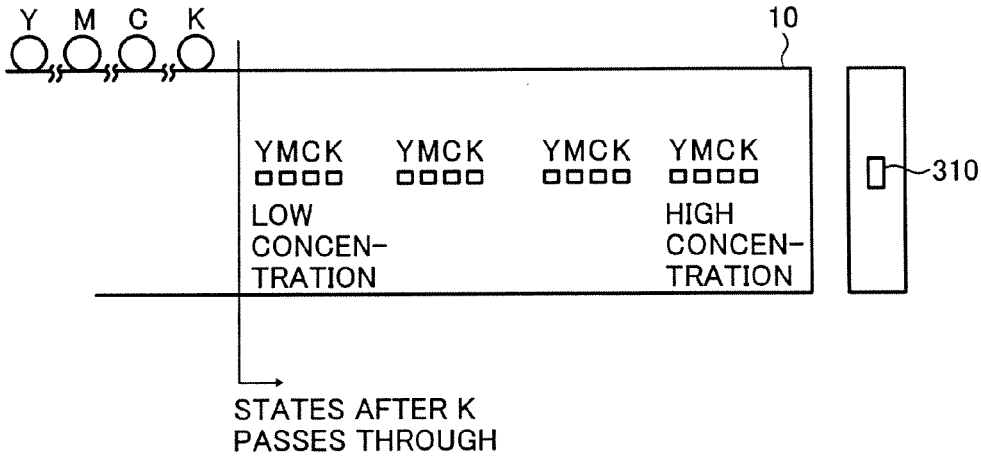
FIG. 23 is a schematic representing another transfer process of transferring gradation pattern according to the exemplary embodiment to the transfer belt.

FIG. 13 is an illustration arranged for each color representing toner patches and corresponding development potential. It does not matter on processing order, and both cases shown in FIGS. 18 and 23 are applicable because the processing order of the image forming on actual transfer belt does not affect the calculation of the development value γ and the sensitivity correction coefficients α and η. Forming the image as shown in FIG. 18 contributes reduction of process time because of parallel writing in addition to reduction of number of the toner patches, and equalization of the toner consumption. This will be described later.

Referring to FIG. 8, it can bee seen that a plurality of toner patches is formed having different adhesive amounts and of the Y, M, and C-color toner. The color data points for calculating the sensitivity correction coefficients α and η are uniformly distributed. Accordingly, the sensitivity correction coefficients α and η are calculated accurately.

The toner patches having differences in gradation concentrations are formed at each color. Referring to FIG. 13 that is rearranged from FIG. 8 conceptually, the gradation pattern similar to FIG. 8 is formed at each color. Accordingly, the development value γ can be calculated accurately.

The gradation pattern may be employed only for the toner patch at high concentration region to calculate the sensitivity correction coefficient α, and may be employed only for the toner patch at low concentration region to calculate the sensitivity correction coefficient η.

Figure 9:
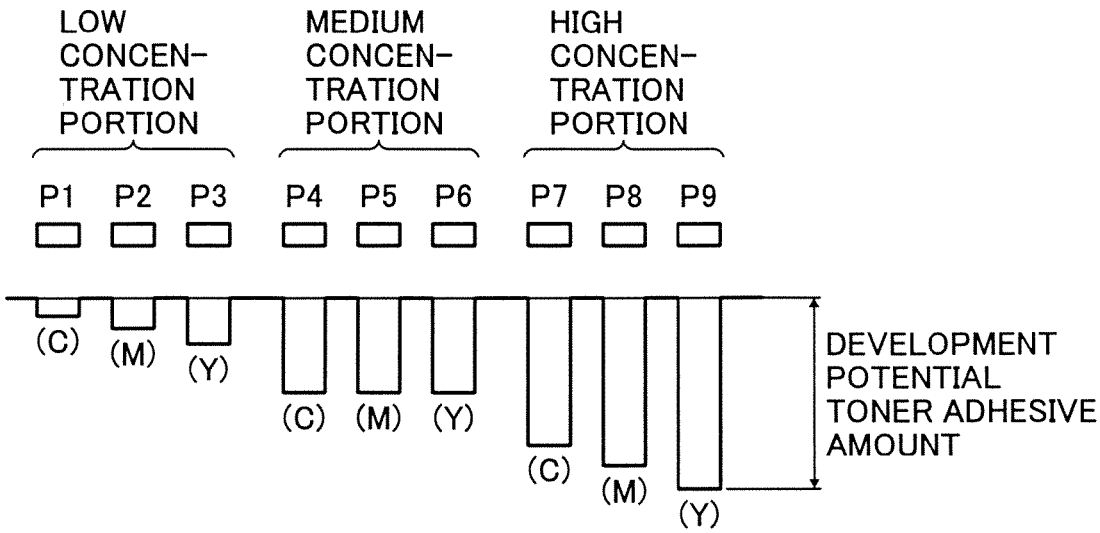
FIGS. 9, 10, 11 are other examples of gradation pattern according to the exemplary embodiment.

For example, in the gradation pattern comprised of 9 toner patches as shown in FIG. 9, P1, P4 and P7 are formed by C-color, and P2, P5 and P8 are formed by M-color, and P3, P6 and P9 are formed by Y-color. In the toner patches P1, P2 and P3 at low concentration region to calculate the sensitivity correction coefficient η, the toner patches are formed with an image forming condition (development potential) to have different toner adhesive amounts. Similarly, in the toner patches P7, P8 and P9 at high concentration region to calculate the sensitivity correction coefficient α, the toner patches are formed with an image forming condition (development potential) to have different toner adhesive amounts. In the toner patches P4, P5 and P6 at medium concentration region, the toner patches may be formed with a image forming condition (development potential) to have uniform toner adhesive amounts.

Using the above-described gradation pattern, the data points in the effective data range to calculate the sensitivity correction coefficient η, and the data points around the minimum value of the ratio of the regular-reflection light output (ΔVsp_reg) and the diffuse-reflection light output (ΔVsp_dif) to calculate the sensitivity correction coefficient α can be distributed uniformly. As a result, it is possible to calculate the sensitivity correction coefficients α and η accurately. Further, as the three toner patches having different toner adhesive amounts are formed, it is possible to calculate the development value γ accurately.

Figure 10:
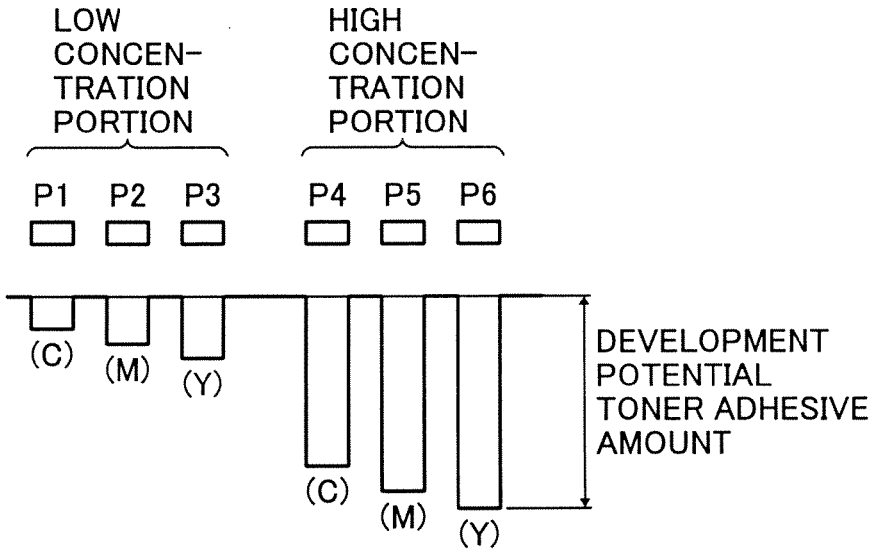
Figure 11:
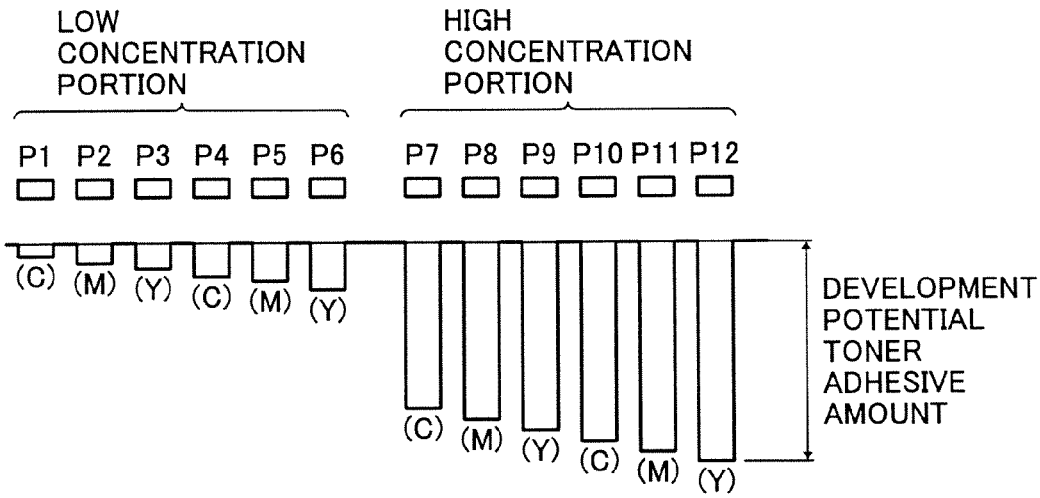

There must be at least six toner patches for the gradation pattern comprising C, M and Y-color. As shown in FIG. 10, gradation pattern comprising C, M and Y-color may only include toner gradation patterns at the high and low concentration regions. As shown in FIG. 11, the toner patches P1 through P6 having different toner adhesive amounts at low concentration region may be formed. The toner patches P7 through P12 having different toner adhesive amounts at high concentration region may be formed. As a result, it is possible to calculate the sensitivity correction coefficients α and η accurately because of increase of data points in the effective data region.

In the examples shown in FIGS. 8, 9, 10 and 11, the toner patches are formed in order of C-color, M-color and Y-color successively. Alternatively, however, other orders and combinations are possible. For example, the toner patches P1, P2 and P3 at the low concentration region may be formed by Y-color, the toner patches P4, P5 and P6 at the medium concentration region may then be formed by M-color, and the toner patches P7, P8 and P9 at the high concentration region may be formed by C-color.

It is desirable to form a gradation pattern by selecting toner patches that have close relation on gradation concentration and by changing color and the gradation concentration to follow the successive order like C-color, M-color and Y-color because the data points are almost uniformly distributed at the calculation of the development value γ.

When the toner patches are formed by such forming procedure, each color toner may be consumed equally and this forming procedure is better for the system to have a longer life with respect to the total toner consumption for all colors. If the development values γ are distributed within a possible range to calculate the development value γ, longer life of the total toner consumption may be possible at a specific condition described later, even in the case in which at least two toner patches having successive gradation concentration with same color are formed as shown in FIG. 24.

Figure 24:
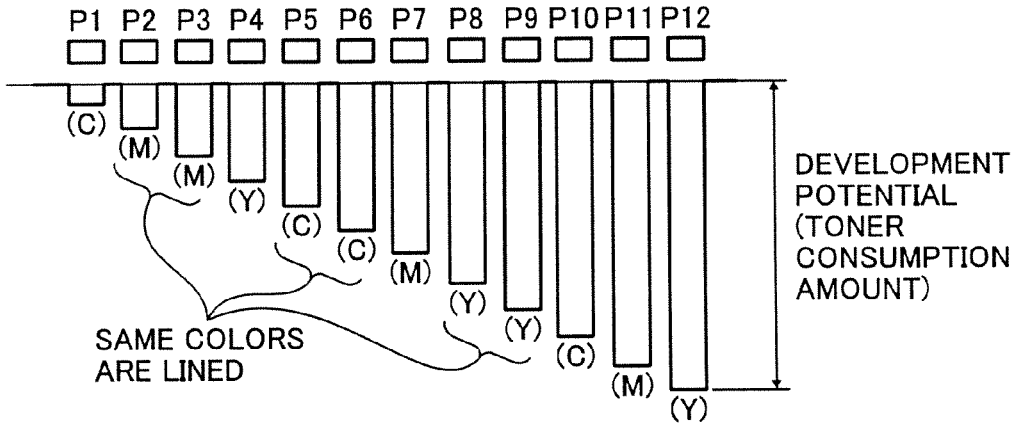
FIG. 24 shows other examples of gradation patterns according to the exemplary embodiment.

Specifically, when there is a difference in the toner consumption amount for equal image concentrations among colors or a deviation depending on output pattern specified by user, it is also possible to control the toner consumption speeds by employing the gradation pattern as shown in FIG. 24 so as to contribute to obtain longer life. In other words, toner patch forming condition for calculating the sensitivity correction coefficients α and η, and the development values γ, is modified for each color and is used to adjust the toner consumption speeds for different colors.

More specifically, the deviation depending on output pattern specified by user is detected and the toner patch of each color is determined based on the detection results. For example, when toner consumption amounts are as a following relation, Y-color<C-color<N-color, toner patches with Y-color are lined at high gradation portion, and toner patches with M-color are lined at low gradation portion as shown in FIG. 24 such that toner consumption speeds are adjusted. Further, this procedure is also effective to calculate the development values γ only for a specific color, and for close to high gradation condition or low gradation condition. Furthermore, the best concentration (better toner patch) gradation pattern may be formed at each color such that the development values γ are calculated accurately.

A description is now given of the method of forming the gradation pattern comprised of C, M, and Y colors.

As for C, M and Y-colors, although the toner concentration is controlled to be a target development value γ, i.e., γ=1.50 [(mg/cm$^2$)/−kV], the development values γ of colors may actually be different. When one gradation pattern is formed by three colors, and there are differences among development values γ of the colors, it may be difficult to obtain much difference in actual toner adhesive amount using common values of development-DC-bias and charge-DC-bias among colors, even when the toner patches have different toner adhesive amounts.

To avoid this problem, the toner adhesive amounts of three colors Y, C and M-color are made to be distributed uniformly so as to form one gradation amount and each target adhesive amount is determined to have different adhesive amounts. Image forming potentials that are determined by the development-DC-bias and the charge-DC-bias are determined at each target adhesive amount.

The forming method of the gradation pattern will now be described in greater detail. The image forming potentials are determined by image concentration control. Specifically, in the image concentration control, the highest development potential is determined using following formula with inputs of the development potential γ and the development-start voltage Vk that are calculation results based on the detection value of the gradation pattern detected by the light sensor at each color. Based on the highest development potential, image forming potentials such as the development-DC-bias and the charge-DC-bias are determined according to the following formula:

$$\text{maximum development potential [−kV]} = \text{target adhesive amount [mg/cm}^2\text{]/development value } \gamma\text{[(mg/cm}^2\text{)/−kV]} + \text{development start voltage: } Vk\text{[−kV]} \quad (13)$$

When the exposure device 21 is a multiple-value-writing system, it is possible to form a gradation pattern having different adhesive amount among the three colors Y, C, and M by making the LD on-duty different at each toner patch. When the exposure device 21 is a binary-writing system that just turns LD on/off, it is possible to form a gradation pattern having different adhesive amount among three colors Y, C, and M by changing the development-DC-bias and the charge-DC-bias at each toner patch.

A calculation method of the image forming of the gradation pattern at each color is described based on exemplary embodiments 1 and 2. The exemplary embodiments 1 and 2 represent cases to form gradation pattern shown in FIG. 8.

Figure 12:
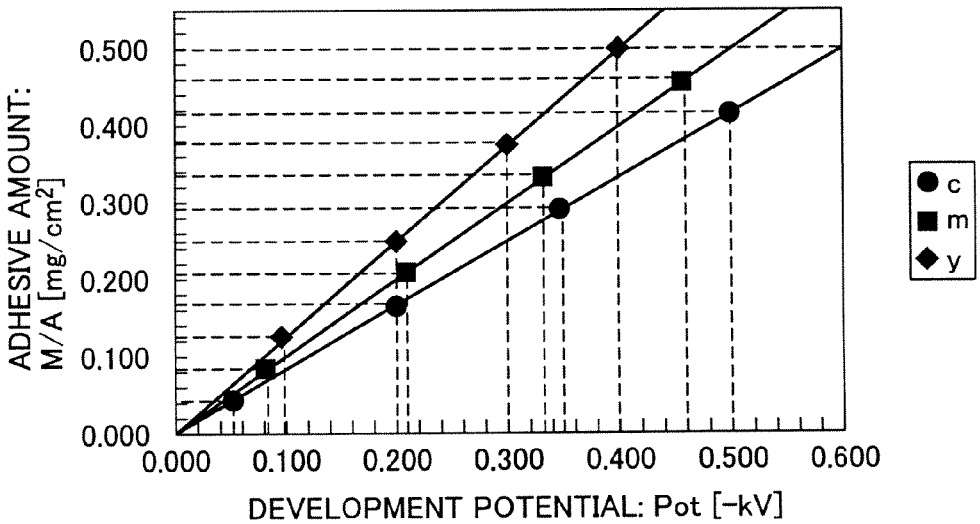
FIG. 12 is a graph representing a toner adhesive amount characteristic versus development potential.

In one exemplary embodiment, the image forming condition at image forming process of each toner patch is determined based on a predetermined toner adhesive amount, using a procedure described referring to FIG. 12.

Toner adhesive amount (0.5 [(mg/cm$^2$)] at plain portion (adhesive amount having largest image concentration) is equally divided (12 divisions) by number of toner patches. As a result, a target toner adhesive amount for each toner patch is determined. The image forming condition (development potential) is then determined by the obtained target toner adhesive amount, the development potential γ and the development-start voltage Vk, respectively. More specifically, the target toner adhesive amount for toner patch P1 is (0.5/12 [(mg/cm$^2$)], and the C-color development potential that forms the toner patch P1 is 0.05 [−kV] as shown in FIG. 12. Accordingly, toner patch can be formed with the image forming condition to have a desired adhesive amount.

In another exemplary embodiment, the image forming condition at image forming of each toner patch is determined based on the highest development potential.

In the above-described method to determine the image forming condition based on the adhesive amount, a lot of calculation steps, for example, the calculation of the toner adhesive amount of the toner patch at the plain portion, and the calculation of the development potential based on the toner adhesive amount of the toner patch are needed.

In the above-described another exemplary embodiment, the calculation of the image forming condition of each toner patch is simplified in consideration of following facts. Specifically, the development potential γ has a nearly linear line characteristic such that primary approximation is possible with high accuracy, and highest concentration (plain patch toner) for each color is substituted by the development potential. The image forming condition of each toner patch is calculated by dividing each highest development potential equally by the number of toner patches (12 division). Accordingly, the calculation of the image forming condition of each toner patch (development potential) is as follows. PotMax is the highest development potential.

$$P1(c) = \text{PotMAX}(c) \times (1/12)$$

$$P2(m) = \text{PotMAX}(m) \times (2/12)$$

$$P3(y) = \text{PotMAX}(c) \times (3/12)$$

$$P4(c) = \text{PotMAX}(c) \times (4/12)$$

$$P5(m) = \text{PotMAX}(m) \times (5/12)$$

$$P6(y) = \text{PotMAX}(c) \times (6/12)$$

$$P7(c) = \text{PotMAX}(c) \times (7/12)$$

$$P8(m) = \text{PotMAX}(m) \times (8/12)$$

$$P9(y) = \text{PotMAX}(c) \times (9/12)$$

$$P10(c) = \text{PotMAX}(c) \times (10/12)$$

$$P11(m) = \text{PotMAX}(m) \times (11/12)$$

$$P12(y) = \text{PotMAX}(c) \times (12/12)$$

After obtaining the development potential for each patch by the calculation method shown in the above-described exemplary embodiments, development-DC-potential, charge-DC-potential and writing-light density are determined to become the calculated development potential.

In the range from 0 to 1 of the above-described exemplary embodiments, values obtained by dividing by the number of toner patches is multiplied. However, the value to multiply can be other numbers that are almost uniformly distributed in the range from 0 to 1 and may not be related to the number of toner patches. For example, the value to multiply may be (m+0.5)/12 to calculate development potential to form Pm color.

When a writing-light of the exposure device 21 is binary, the development-DC-bias and the charge-DC-bias are adjusted to match the calculated development potential. An example to adjust development bias is now described.

The development potential is obtained by formula, (development bias—electrostatic-latent image potential (exposure portion)). Therefore, the development bias at image forming process of the toner patch is obtained by following formula, development bias={(maximum development potential PotMAX)×(n/12)}+electrostatic latent image potential, where n is toner patch number.

Meanwhile, when the exposure device 21 is a multiple-value-writing system, LD on-duty "a %" may be used by being uniformly divided by the number of toner patches (12: dividing equally), where the development-DC-bias and the charge-DC-bias of each color are used as the image potential, the LD on-duty of the exposure apparatus to obtain the highest concentration (plain patch toner) is 100% duty, and the LD on-duty to start development is "a %".

More specifically, the LD on-duty (writing-light density) to form each toner patch is as follows.

$$P1(c)=(1/12)\times(100\%-a)+a$$

$$P2(m)=(2/12)\times(100\%-a)+a$$

$$P3(y)=(3/12)\times(100\%-a)+a$$

$$P4(c)=(4/12)\times(100\%-a)+a$$

$$P5(m)=(5/12)\times(100\%-a)+a$$

$$P6(y)=(6/12)\times(100\%-a)+a$$

$$P7(c)=(7/12)\times(100\%-a)+a$$

$$P8(m)=(8/12)\times(100\%-a)+a$$

$$P9(y)=(9/12)\times(100\%-a)+a$$

$$P10(c)=(10/12)\times(100\%-a)+a$$

$$P11(m)=(11/12)\times(100\%-a)+a$$

$$P12(y)=(12/12)\times(100\%-a)+a$$

The detection results of the light sensor is now described when the gradation pattern is a 12-step gradation of Y, M, and C-color referring to the experiments 1 and 2.

In the above-described procedure, each toner patch is formed using method of "pulse width modulation". In the method of "pulse width modulation", LD on-duty (writing-light density) is changed. However, other LD modulation method can be used as LD modulation method such as method of "power modulation" (writing-light strength) in which LD power is changed.

[Experiment-1]

The experiment-1 is an example experiment to form gradation pattern of each toner patch by uniformly distributing the LD on-duty of the exposure device 21 under the image potential of charge/development bias.

Figure 14:
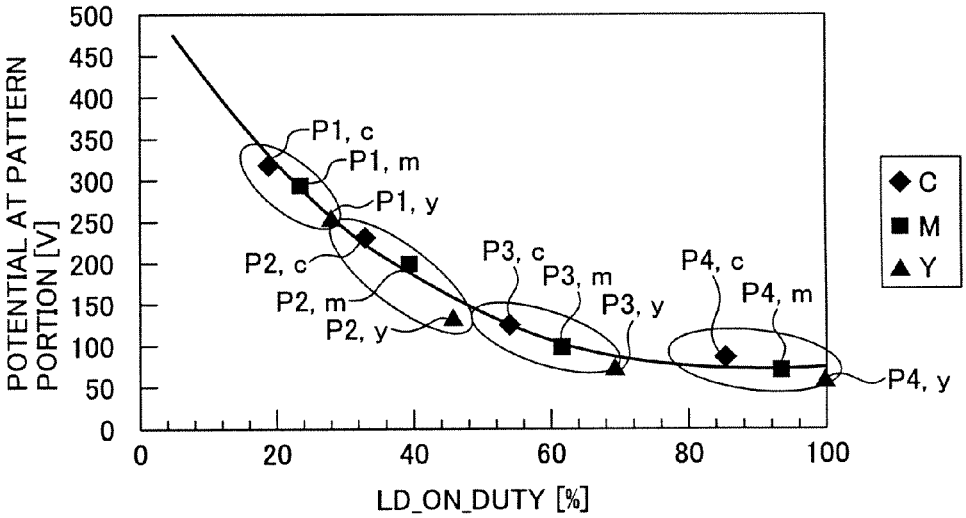
FIG. 14 is a schematic representing potentials at exposure part of each toner patch.
Figure 15:
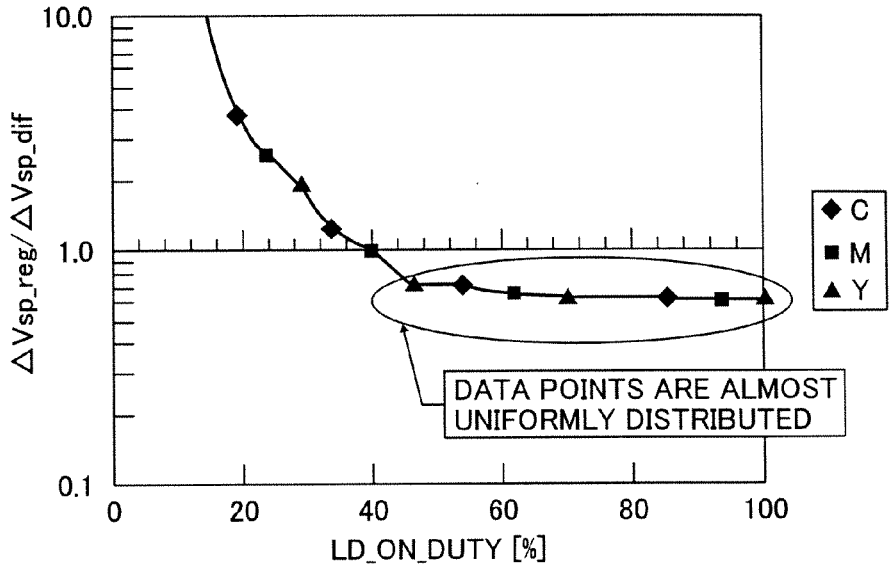
FIG. 15 is a graph representing a relation between (regular reflection light output ((ΔVsp_reg)/diffuse reflection light output (ΔVsp_dif)) at a detection of the gradation pattern of the exemplary embodiment, and LD on-duty at formation of each toner patch.

FIG. 14 is a graph representing potentials at exposure portion of each toner patch in the experiment. FIG. 15 is a graph representing a relation of the LD on-duty, and the ratio of the regular-reflection light output (ΔVsp_reg) and the diffuse-reflection light output (ΔVsp_dif) to calculate sensitivity correction coefficient α from the detection value of each toner patch detected by the light sensor. As shown in FIG. 15, data points around the minimum value of the ratio of the regular-reflection light output (ΔVsp_reg) and diffuse-reflection light output (ΔVsp_dif) are not overlapped but are distributed uniformly.

Figure 16:
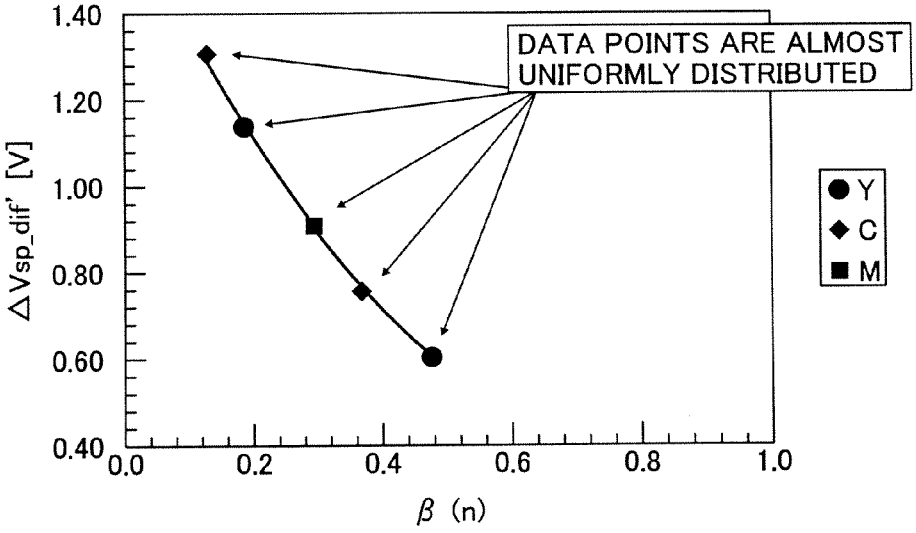
FIG. 16 is a graph representing a relation between normalization value of regular reflection element at calculation of a sensitivity correction coefficient η using detection value of the gradation pattern of the exemplary embodiment, and diffuse light output ΔVsp_dif' after correction.

FIG. 16 is a graph plotted with the data points obtained from each toner patch in the effective range to calculate the sensitivity correction coefficient η. In the graph, normalization value β[n] is in horizontal axis and the diffuse-reflection light output (ΔVsp_dif) is in vertical axis. As shown in FIG. 16, the data points in the effective data range to calculate the sensitivity correction coefficient η are not overlapped but are distributed uniformly.

In the experiment-1, the polynomial approximation of the processing-2 is used to calculate the sensitivity correction coefficient η. Using the polynomial approximation, it is possible to expand the effective data range extending to a non-linear region. As a result, the data points to be used for calculation of the sensitivity correction coefficient η increase such that it is possible to calculate accurately.

[Experiment-2]

The experiment-2 is an example experiment to form gradation pattern of each toner patch by employing a fixed LD on-duty, and making a charge bias and a development bias variable. Specifically, the experiment-2 is the example experiment when the exposure device 21 is a multiple-value-writing system.

Figure 17:
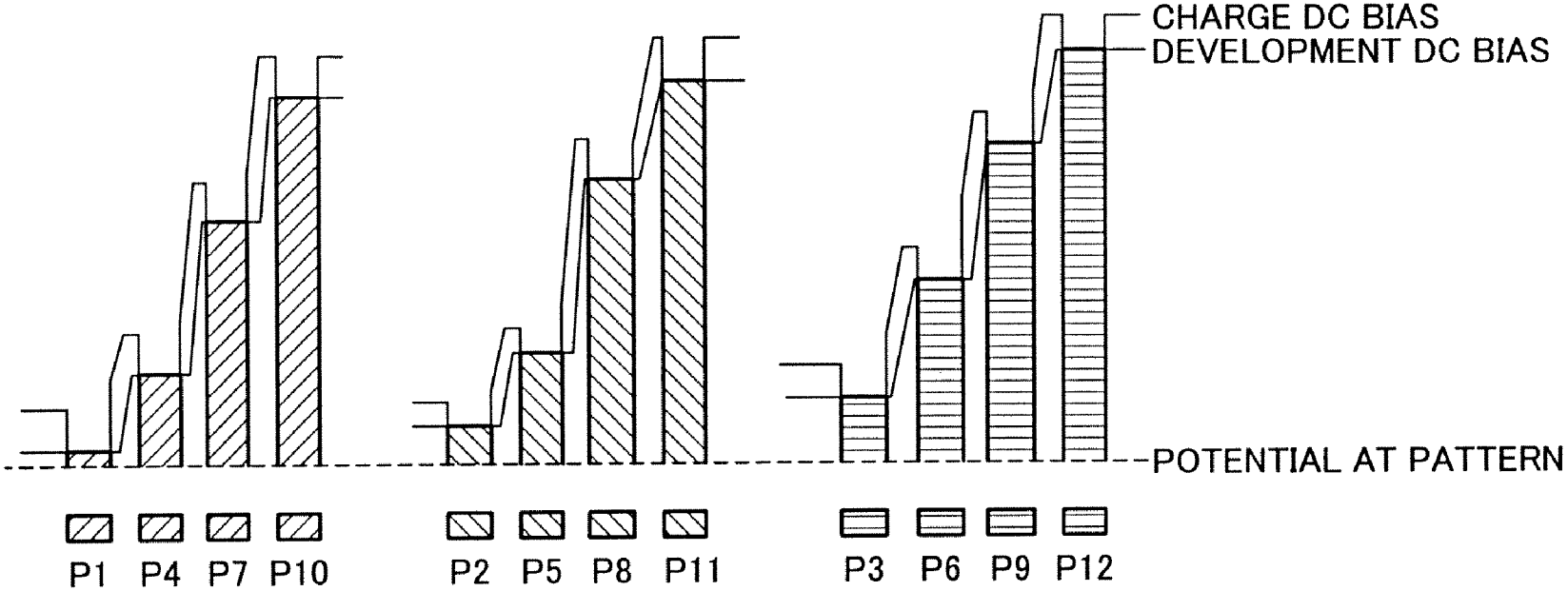
FIG. 17 is a schematic representation of surface potentials of a photoreceptor.

FIG. 17 is an illustration of outline graph representing surface potentials of the photoreceptor. As shown in FIG. 17, since exposure potentials are constant value, the charge-DC-bias and the development-DC-bias are changed to change the development potentials such that the toner adhesive amount of each toner patch is made different.

The toner adhesive amount of each toner patch formed in this procedure becomes similar adhesive amount to the adhesive amount of the experiment-1. As a result, the result can be shown in FIGS. 15 and 16 similarly. The data points that are necessary to calculate the sensitivity correction coefficients α and η are not overlapped but are distributed uniformly.

A reason why detection time to detect a gradation pattern as shown in FIG. 18 is shortened when the gradation pattern is formed on the transfer belt 10 is now described.

Figure 19:
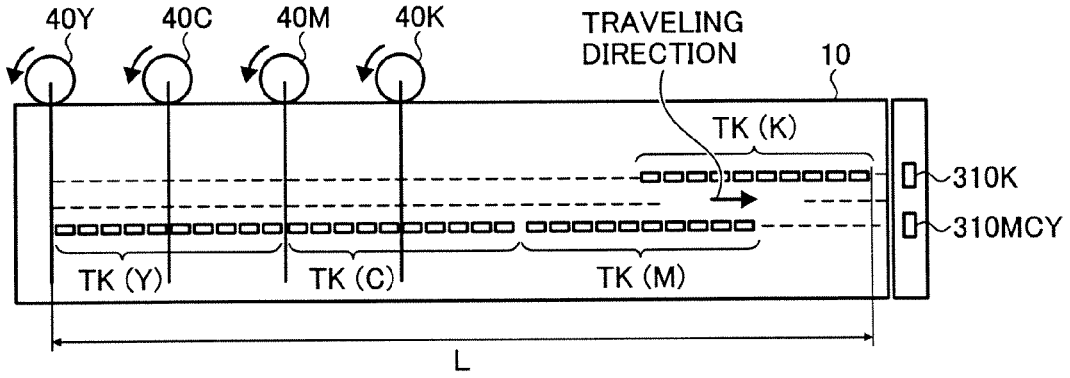
FIG. 19 is a schematic representation of a transfer process to transfer conventional gradation pattern to a transfer belt.

Previously, as shown in FIG. 19, gradation pattern comprised of 10-step gradation is formed for each color. As for each toner patch, a length in a main scanning direction is 15 mm, a length in a direction of sub-scanning (patch length) is 25 mm, and distance between patches is 10 mm. A patch pitch of the toner patches is 150 mm. length of the gradation pattern comprising 10-step gradation, i.e., (25 mm (patch length))× 10 (number of patches)+10 mm (distance between patches)×9 (number of patches−1)−340 mm), is more than twice length of the photoreceptor. Accordingly, the toner patch of Y, M, and C-color can not be formed on the transfer belt at same position, at the same time, and in a longitudinal direction.

Figure 20:
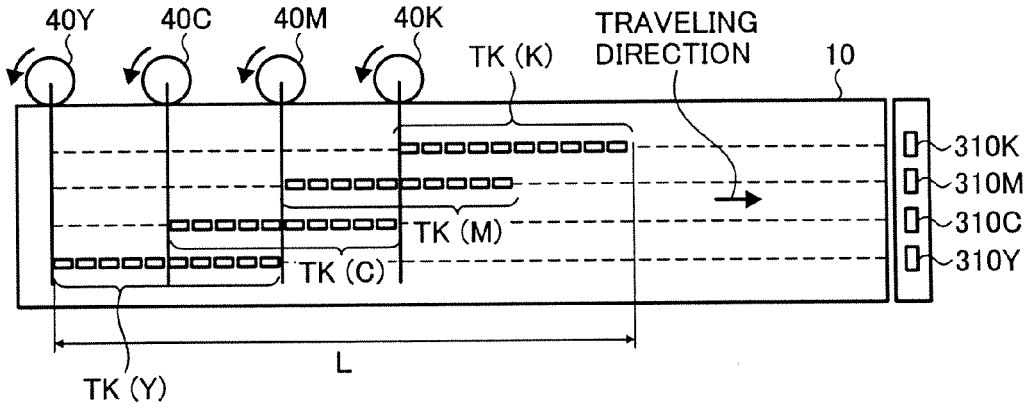
FIG. 20 is a schematic representation of a transfer process of transferring gradation pattern to a transfer belt in an arrangement in which four sensors are provided.
Figure 21:
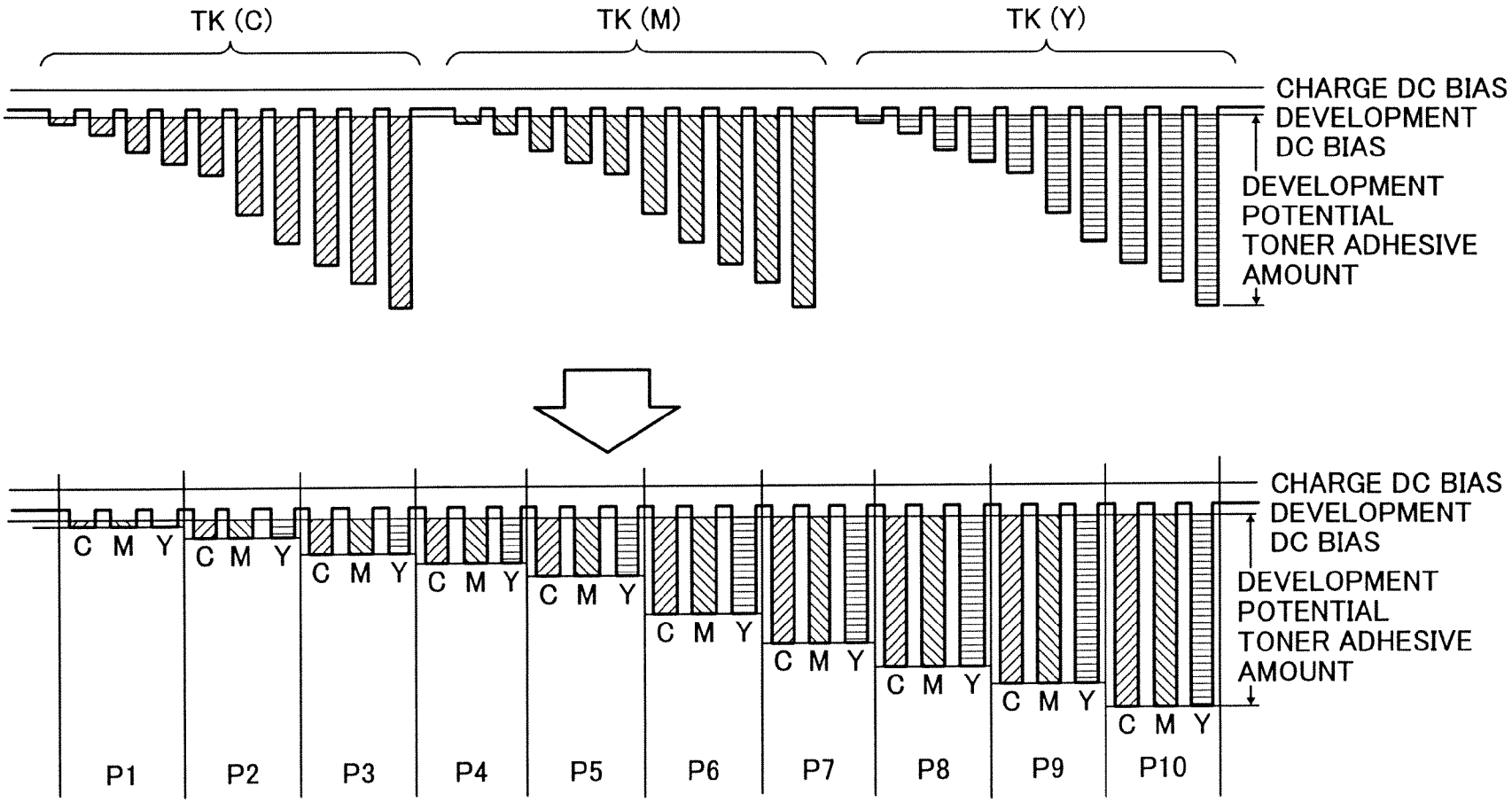
FIG. 21 is a schematic diagram illustrating a conventional gradation pattern.

Forming process of the toner patch of C-color starts a predetermined time after the forming process of the toner patch of M-color started. Forming process of the toner patch of Y-color starts a predetermined time later after the forming process of the toner patch of C-color started. Thus, as the forming process of each toner patch starts successively after a predetermined time, the detection time of the gradation pattern increases. As shown in further figure FIG. 20, light sensors 310K, 310Y, 310M and 310C, for each color are provided at different positions to detect each color at the same time. As a result, the gradation pattern of each toner patch can be formed at the same time. However, this causes high cost due to necessity of the four sensors.

In arrangement of the light sensors shown in FIG. 19, a possible number of toner patches that can be formed at the same time is considered.

If the number of toner patches satisfies a formula, (patch length)×(number of patches)+(distance between patches)×(number of patches−1)<(photoreceptor pitch), the toner patch of Y, M, and C-color can not be formed at the same time.

Substituting the following values in the above formula, patch length: 25 mm, distance between patches 10 mm, and photoreceptor pitch: 150 mm, (number of patches)<(photoreceptor pitch+distance between patches)/(patch length+distance between patches)

(number of patches)<(150+10)/(25+10)

(number of patches)<4.57 are obtained. Specifically, if the number of toner patches is equal to and less than four, it is possible to form the toner patches of Y, M, and C-color at the same time and to detect by one sensor.

In this exemplary embodiment, gradation pattern K1 having 12-step gradation is formed by four toner patches of Y, M, and C-color. As a result, the toner patches of three colors are formed at a same time. Further, as for black color as shown in FIG. 18, if four toner patches are employed, it is possible to form the toner patches of K, Y, M, and C-color at the same time by one sensor. As a result, detection time of a higher order is shortened.

The above-described light sensor is comprised of the emitting device to emit infrared rays (GaAs emitting diode having peak emitting wavelength of 940 nm) and the receiving device to receive infrared rays (Si photo transistor having peak spectroscopic sensitive wavelength of 850 nm). However, other configuration is possible. For example, the emitting device may emit a light having a wavelength from visible-light to infrared rays and the receiving device may receive a light having a wavelength of visible-light or a light having a wavelength of infrared rays. Or, the receiving device may receive a light having a wavelength from visible-light to infrared rays and the emitting device may emit a light having a wavelength of visible-light or a light having a wavelength of infrared rays.

As shown in FIG. 4A in this exemplary embodiment, the light sensor detects a light having a wavelength of equal to and more than 830 nm. However, some toner has a reflection rate that does not change even if wavelength is equal to and more than a limit of long wavelength, i.e., 760 nm. Accordingly, when the toner having a reflection rate that does not change in wavelength of equal to and more than 760 nm is used, the light sensor to detect a light having a wavelength of more than 760 nm may be employed.

Figure 22:
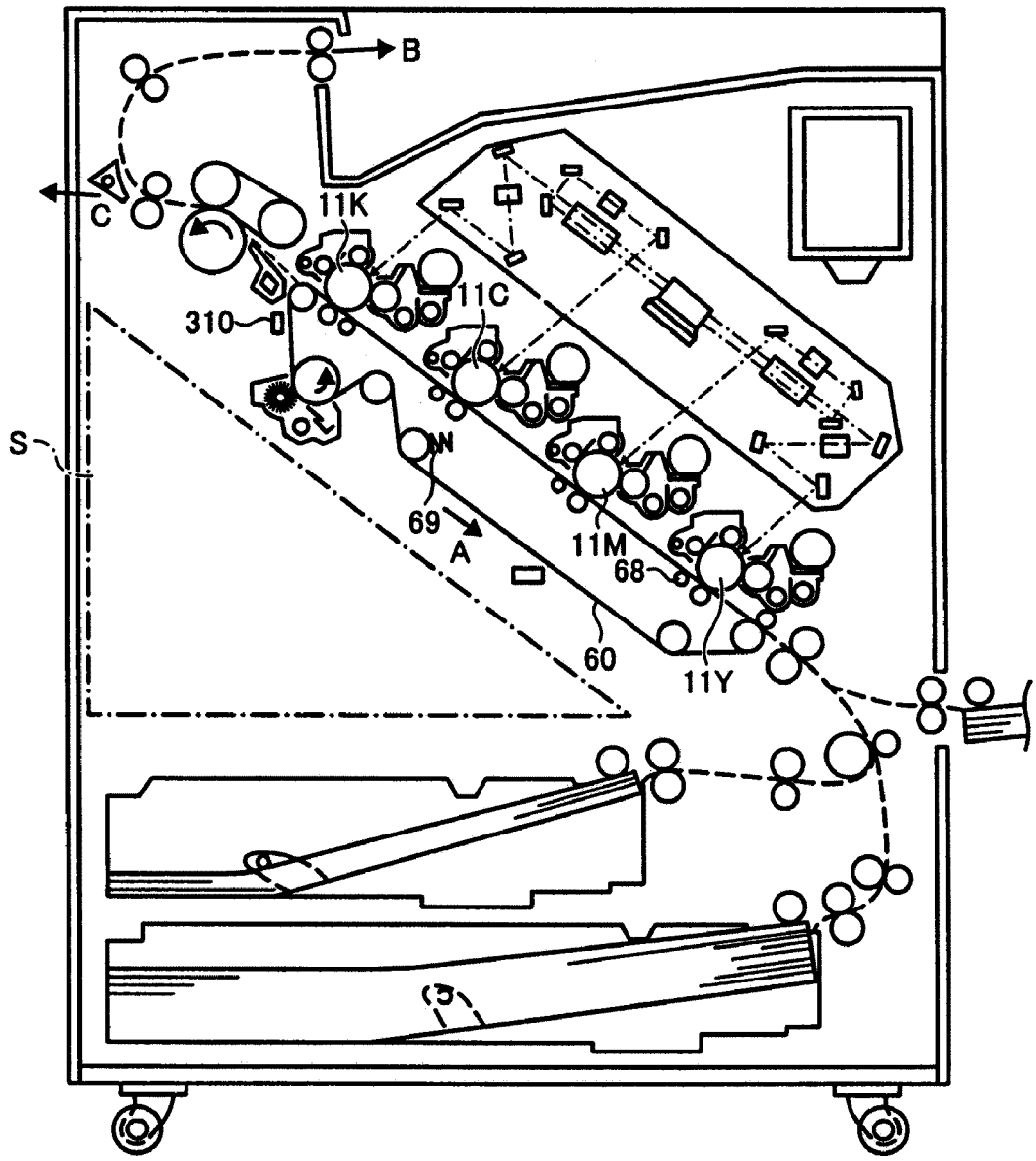
FIG. 22 is an outline of another copier according to the exemplary embodiment.

In this exemplary embodiment of the image forming apparatus, a full color image is formed by transferring four color toner images on the photoreceptors 40Y, 40M, 40C and 40K onto the intermediate transfer belt by superimposing successively. However, other configuration may be possible. FIG. 22 is an outline of another copier according to the exemplary embodiment. As shown in FIG. 22. a transfer paper is conveyed by the transfer convey belt 60 and four color toner images on the photosensitive drums 11Y, 11M, 11C and 11K are transferred by superimposing successively.

In this exemplary embodiment of the image forming apparatus, the light sensor 310 that is an optical detection means detects infrared rays and near-infrared rays. When the toner adhesive amount of the colors are similar, the detection values of the light sensor 310 are equal even at different colors. Accordingly, if a detection value of the light sensor for one color is obtained, detection value of the other colors that is detected by the optical detection means can be known. As a result, it is not necessary to form a plurality of toner patches having similar adhesive amount with respect to colors. Thus, the number of toner patches can be reduced.

Further, detection time to detect the toner patches is shortened such that down time of the system is shortened. If a plurality of gradation patterns comprised of the toner patches are formed by toner patches of at least two colors, difference of toner consumptions among colors is eliminated in comparison to toner patch with single color.

If detection value for a plurality of gradation patterns, that are comprised of the toner patches having different toner adhesive amount, is used for sensitivity correction of the light sensor, time for correction can be shortened and accurate correction of the light sensor can be performed. The sensitivity correction coefficient $\eta$ at the sensitivity correction of the light sensor is obtained using a polynomial approximation on the relation between the regular-reflection light element and the diffuse-reflection light element from the toner.

Using a polynomial approximation, it is possible to expand the effective data range such that data points for calculation of the sensitivity correction coefficient $\eta$ can be increased in comparison with linear approximation. As a result, it is possible to calculate the sensitivity correction coefficient $\eta$ more accurately in comparison with linear approximation.

Employing the secondary approximation as the polynomial approximation, execution load of CPU (Central Processing Unit) can be reduced with accurate calculation to calculate the sensitivity correction coefficient $\eta$.

In this exemplary embodiment of the image forming apparatus, since an image concentration control is performed using the above-described gradation pattern, time for image concentration control is shortened.

The light sensor includes an emitting element to emit light having a wavelength range with no difference in the reflection rate among colors, and a receiving element to receive light having a wavelength range with no difference in the reflection rate among colors. Accordingly, it is possible to detect the light having a wavelength range with no difference in the reflection rate among colors.

The image forming condition to form each toner patch is obtained by multiplying a reference development potential by predetermined different values, where a development potential to form reference toner image having a predetermined toner adhesive amount is defined to be the reference development potential. Accordingly, gradation pattern comprised of the toner patches having different toner adhesive amount is formed with a plurality of colors even if development values $\gamma$ are slightly different among colors.

The reference toner image may be a plain image. Since the plain image is formed under maximum development potential, the maximum development potential is the reference development potential. The maximum development potential is obtained by the image concentration control. Accordingly, it is not necessary to determine reference development potential newly and to store the reference development potential in a storage device only to form the gradation pattern. Thus, it is possible to simplify the control for forming gradation pattern. It is possible to make memory capacity necessary for the system small.

If a common reference toner image is employed and the toner images are uniformly distributed based on the reference toner image, gradation pattern having a plurality of toner patches with different adhesive amount can be formed by a plurality of colors of toner.

If a reference development potential is defined at each color, gradation pattern having a plurality of toner patches with different adhesive amount can be formed by a plurality of colors of toner.

A value to multiply with the reference development potential is a number in a range between more than 0 and less than 1, and is divided equally by a number of toner patches having different adhesive amount, the toner adhesive amount of each toner patch of the gradation pattern can be uniformly distributed. It is possible to calculate the sensitivity correction coefficients $\alpha$ and $\eta$ accurately.

The image forming condition to form each toner patch is determined by changing the development bias.

The image forming condition to form each toner patch may be determined by changing the LD power that is a strength of the writing light.

The image forming condition to form each toner patch may be determined by changing the LD on-duty that is a density of the writing light.

One of the image forming conditions to form each toner patch such as a development bias, a density of the writing light, and strength of the writing light, may be equal to a value of the image forming condition at printing. Using the above setting, it is not necessary to change above-described conditions to form the toner patch. As a result, unnecessary waiting time that is necessary for condition change is eliminated. Accordingly, a detection time to detect the toner patches is shortened such that a down time of the system is shortened.

Further, since the toner patches for each color are formed at a same time, a detection time to detect the toner patches is shortened.

In the exemplary embodiment, the image forming unit comprises a plurality of photoreceptors arranged in parallel configuration, image is formed on the plurality of photoreceptors individually. Accordingly, a detection time to detect the toner patches is shortened in the tandem-type image forming apparatus in which the toner image formed on each photoreceptor is transferred onto the intermediate transfer that is a secondary image carrier moving endlessly by touching the photoreceptor.

The pattern image of each color is comprised of a plurality of the toner patches and is formed on each photoreceptor. The length of the pattern image of each color becomes shorter than length of the photoreceptor pitch. Accordingly, it is possible to form the toner patch of each color at the same time.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image forming unit configured to form a plurality of toner images on an image carrier of a plurality of image carriers;

an optical detector configured to detect reflection light from a toner image of the plurality of toner images, and dedicated to detect infrared rays and near-infrared rays; and a controller configured to perform sensitivity correction control for the optical detector using a detection value detected by the optical detector, wherein a gradation pattern is comprised of a plurality of toner patches formed in the image forming unit with an image forming condition to have different adhesive amounts, and is formed of at least two colors, and detection values detected by the optical detector are used for a predetermined control, at least one toner patch of the plurality of toner patches includes only one color, and a length of the gradation pattern having the plurality of toner patches is shorter than a pitch length between the image carriers.

2. The image forming apparatus of claim 1, wherein a sensitivity of the optical detector is corrected based on the sensitivity correction coefficient obtained by polynomial approximation on relation between a regular-reflection light element extracted from a regular-reflection light output of the optical detector and a diffuse-reflection light element out of a toner extracted from diffuse-reflection light output of the optical detector.

3. The image forming apparatus of claim 2, wherein the polynomial approximation is a secondary equation approximation.

4. The image forming apparatus of claim 1, wherein an image concentration control is performed using detection value detected by the optical detector.

5. The image forming apparatus of claim 1, wherein the optical detector comprises:

an emitting device to emit infrared rays and near-infrared rays; and a receiving device to receive infrared rays and near-infrared rays.

6. An image forming apparatus, comprising:

an image forming unit configured to form a plurality of toner images on an image carrier;

an optical detector configured to detect reflection light from a toner image of the plurality of toner images, and dedicated to detect infrared rays and near-infrared rays; and a controller configured to perform sensitivity correction control for the optical detector using a detection value detected by the optical detector, wherein a gradation pattern is comprised of a plurality of toner patches formed in the image forming unit with an image forming condition to have different adhesive amounts, and is formed of at least two colors, and detection values detected by the optical detector are used for a predetermined control, at least one toner patch of the plurality of toner patches includes only one color, and the image forming condition is determined by multiplying reference potential that is a development potential to form a reference image having a predetermined toner adhesive amount by predetermined different values.

7. The image forming apparatus of claim 1, wherein the image forming condition is determined by multiplying reference potential that is a development potential to form a reference image having a predetermined toner adhesive amount by predetermined different values.

8. The image forming apparatus of claim 7, wherein the reference image is a plain image.

9. The image forming apparatus of claim 8, wherein the reference image is identical for each color.

10. The image forming apparatus of claim 9, wherein value of the reference development potential is determined respectively for each color.

11. The image forming apparatus of claim 7, wherein each value multiplied by the reference development potential is distributed uniformly in a range from 0 to 1.

12. The image forming apparatus of claim 7, wherein each toner patch is formed under different development potential.

13. The image forming apparatus of claim 7, wherein each toner patch is formed under different strength of writing light for the image carrier.

14. The image forming apparatus of claim 7, wherein each toner patch is formed under different density of writing light for the image carrier.

15. The image forming apparatus of claim 7, wherein at least one of image forming conditions of the development bias, the strength of writing light, and the density of writing light to form the toner patch is equal value to an image condition at printing.

16. The image forming apparatus of claim 1, wherein the image forming unit forms each toner patch at one time.

17. The image forming apparatus of claim 16, wherein an image is formed on a recording medium either by successively transferring toner images of different colors formed on the plurality of image carriers onto a recording medium conveyed by an endless moving member that contacts the plurality of image carriers or by transferring the toner images onto the recording medium by one operation after successively transferring the toner images formed onto the endless moving member.

18. The image forming apparatus of claim 1, wherein the plurality of toner patches is less than or equal to four.

19. The image forming apparatus of claim 1, wherein the plurality of toner patches is less than or equal to four and the image forming unit forms each of the plurality of toner patches at one time.

20. The image forming apparatus of claim 5, wherein the receiving device includes a first device to receive the infrared rays and a second device to receive the near-infrared rays, the first device and the second device being positioned at different angles with respect to the image carrier.

* * * * *